US008360740B2

(12) United States Patent
Leppert et al.

(10) Patent No.: US 8,360,740 B2
(45) Date of Patent: Jan. 29, 2013

(54) INTEGRATED FUEL DELIVERY MODULE AND METHODS OF MANUFACTURE

(75) Inventors: Kevin L. Leppert, Lanexa, VA (US); Jason D. Keown, Williamsburg, VA (US)

(73) Assignee: Synerject, LLC, Newport News, VA (US)

( * ) Notice: Subject to any disclaimer, the term of this patent is extended or adjusted under 35 U.S.C. 154(b) by 372 days.

(21) Appl. No.: 12/705,042

(22) Filed: Feb. 12, 2010

(65) Prior Publication Data

US 2011/0200472 A1 Aug. 18, 2011

(51) Int. Cl.
*F04B 43/12* (2006.01)
*F04B 49/06* (2006.01)

(52) U.S. Cl. ..... 417/53; 417/310; 417/313; 417/410.4; 123/509

(58) Field of Classification Search ..... 417/53, 417/410.4, 313, 310, 440, 423.14, 423.9, 417/423.3; 418/61.3, 166, 171, 46, 47, 88, 418/89; 123/510, 509
See application file for complete search history.

(56) References Cited

U.S. PATENT DOCUMENTS

| | | | |
|---|---|---|---|
| 3,507,263 | A | 4/1970 | Long |
| 4,860,714 | A | 8/1989 | Bucci |
| 5,070,849 | A | 12/1991 | Rich et al. |
| 5,080,077 | A | 1/1992 | Sawert et al. |
| 5,103,793 | A | 4/1992 | Riese et al. |
| 5,289,810 | A | 3/1994 | Bauer et al. |
| 5,341,842 | A | 8/1994 | Chih et al. |
| 5,361,742 | A | 11/1994 | Briggs et al. |
| 5,389,245 | A | 2/1995 | Jaeger et al. |
| 5,415,146 | A | 5/1995 | Tuckey |
| 5,452,701 | A | 9/1995 | Tuckey |
| 5,458,767 | A | 10/1995 | Stone |

(Continued)

FOREIGN PATENT DOCUMENTS

| | | | |
|---|---|---|---|
| CN | 2916171 | Y | 6/2007 |
| DE | 198 24 246 | A1 | 12/1998 |

(Continued)

OTHER PUBLICATIONS

Johnston, "Choosing the Right Welding Process," [online] MD&DI [retrieved on May 8, 2007], Retrived from the Internet, URL:http://www.devicelink.com/mddi/archive/05/09/014.html, pp. 1-4.

(Continued)

*Primary Examiner* — Devon Kramer
*Assistant Examiner* — Ryan Gatzemeyer
(74) *Attorney, Agent, or Firm* — Cooley LLP

(57) ABSTRACT

An apparatus includes a housing defining a first cavity containing a pump, a second cavity containing a filter and a lumen configured to provide fluid communication between the first cavity and the second cavity. The housing has a first end portion configured to be disposed within a fluid reservoir and a second end portion including a flange configured to be disposed outside of and coupled to the fluid reservoir. A surface of the first end portion defines a first opening in fluid communication with the first cavity. A surface of the second end portion defines a second opening in fluid communication with the second cavity. A cover is configured to be removably coupled to the second end portion of the housing about the second opening such that the filter can be removed from the second cavity when the flange is coupled to the fluid reservoir.

20 Claims, 16 Drawing Sheets

U.S. PATENT DOCUMENTS

| | | | | |
|---|---|---|---|---|
| 5,469,829 | A | 11/1995 | Kleppner et al. | |
| 5,520,156 | A | 5/1996 | Brunnhofer | |
| 5,647,330 | A | 7/1997 | Sawert et al. | |
| 5,649,514 | A | 7/1997 | Okada et al. | |
| 5,655,504 | A | 8/1997 | Iwai | |
| 5,715,798 | A | 2/1998 | Bacon et al. | |
| 5,718,208 | A | 2/1998 | Brautigan et al. | |
| 5,727,529 | A | 3/1998 | Tuckey | |
| 5,743,239 | A | 4/1998 | Iwase | |
| 5,769,061 | A | 6/1998 | Nagata et al. | |
| 5,791,317 | A | 8/1998 | Eck | |
| 5,960,775 | A | 10/1999 | Tuckey | |
| 6,106,244 | A * | 8/2000 | Nakatsukasa et al. | 417/313 |
| 6,123,521 | A * | 9/2000 | Mori et al. | 417/423.3 |
| 6,142,126 | A | 11/2000 | Kanamaru | |
| 6,149,399 | A | 11/2000 | Bowser et al. | |
| 6,155,793 | A | 12/2000 | Tuckey et al. | |
| 6,213,143 | B1 | 4/2001 | Schwegler et al. | |
| 6,213,726 | B1 | 4/2001 | Tuckey | |
| 6,216,671 | B1 | 4/2001 | Sawert et al. | |
| 6,220,454 | B1 | 4/2001 | Chilton | |
| 6,241,883 | B1 | 6/2001 | Noda | |
| 6,253,735 | B1 | 7/2001 | Miyajima | |
| 6,260,543 | B1 | 7/2001 | Chih | |
| 6,293,770 | B1 | 9/2001 | Matsumoto et al. | |
| 6,311,725 | B1 | 11/2001 | Hamada et al. | |
| 6,343,589 | B1 | 2/2002 | Talaski et al. | |
| 6,364,630 | B1 | 4/2002 | Craft et al. | |
| 6,424,924 | B1 | 7/2002 | Wagner et al. | |
| 6,439,205 | B2 | 8/2002 | Ushigome | |
| 6,457,458 | B1 | 10/2002 | Frank et al. | |
| 6,488,476 | B2 | 12/2002 | Eck | |
| 6,491,029 | B2 | 12/2002 | Kondou et al. | |
| 6,520,163 | B2 | 2/2003 | Yoshioka et al. | |
| 6,679,227 | B2 | 1/2004 | Sawert et al. | |
| 6,719,539 | B1 * | 4/2004 | Yoshioka | 417/363 |
| 6,729,309 | B2 | 5/2004 | Schueler | |
| 6,733,249 | B2 | 5/2004 | Maier et al. | |
| 6,773,241 | B2 * | 8/2004 | Suzuki et al. | 417/423.3 |
| 6,928,989 | B2 | 8/2005 | Powell | |
| 6,981,490 | B2 | 1/2006 | Nagata et al. | |
| 7,069,912 | B2 | 7/2006 | Yoshioka | |
| 7,146,968 | B2 | 12/2006 | Koito et al. | |
| 7,237,538 | B2 | 7/2007 | Perruchot et al. | |
| 7,278,408 | B1 | 10/2007 | Konopacki | |
| 7,617,814 | B2 | 11/2009 | Leppert | |
| 7,677,225 | B2 | 3/2010 | Radue et al. | |
| 7,775,235 | B2 | 8/2010 | Leppert et al. | |
| 8,079,479 | B2 | 12/2011 | Leppert | |
| 8,113,796 | B2 * | 2/2012 | Marx et al. | 417/360 |
| 2002/0152996 | A1 | 10/2002 | Gabauer et al. | |
| 2003/0000502 | A1 | 1/2003 | Jones et al. | |
| 2003/0024509 | A1 | 2/2003 | Matusek et al. | |
| 2003/0127075 | A1 | 7/2003 | Braun et al. | |
| 2003/0131828 | A1 | 7/2003 | Crary | |
| 2004/0000344 | A1 | 1/2004 | Okabe et al. | |
| 2004/0037713 | A1 * | 2/2004 | Schelhas et al. | 417/313 |
| 2004/0173187 | A1 * | 9/2004 | Kanamaru et al. | 123/509 |
| 2005/0178853 | A1 | 8/2005 | Doble et al. | |
| 2006/0021603 | A1 | 2/2006 | Nagata | |
| 2006/0024176 | A1 | 2/2006 | Ikeya | |
| 2006/0070941 | A1 * | 4/2006 | Cline et al. | 210/416.4 |
| 2006/0096582 | A1 | 5/2006 | Powell et al. | |
| 2006/0130815 | A1 | 6/2006 | Gaffield et al. | |
| 2006/0231079 | A1 | 10/2006 | Paluszewski | |
| 2007/0074770 | A1 | 4/2007 | Witherspoon et al. | |
| 2007/0113830 | A1 | 5/2007 | Koito et al. | |
| 2007/0128049 | A1 | 6/2007 | Sanchez et al. | |
| 2008/0295898 | A1 | 12/2008 | Leppert et al. | |
| 2009/0184044 | A1 | 7/2009 | Leppert | |
| 2009/0223492 | A1 | 9/2009 | Leppert | |
| 2010/0047090 | A1 | 2/2010 | Marx et al. | |
| 2011/0192381 | A1 | 8/2011 | Maruyama et al. | |
| 2012/0080367 | A1 | 4/2012 | Leppert | |

FOREIGN PATENT DOCUMENTS

| | | | |
|---|---|---|---|
| DE | 100 28 458 | A1 | 12/2001 |
| DE | 103 28 206 | A1 | 1/2005 |
| EP | 1 508 688 | A1 | 2/2005 |
| GB | 2 328 659 | A | 3/1999 |
| JP | 2005-256741 | A | 9/2005 |
| WO | WO 2008049900 | A1 * | 5/2008 |

OTHER PUBLICATIONS

"Spin Welding Joint Design," [online] Plastic Assembly Systems [retrieved on May 7, 2007] Retrieved from the Internet, URL: http://www.heatstaking.com/technical-spin-welding-joint-design.htm.

International Search Report and Written Opinion for PCT/US2009/030808, mailed Mar. 11, 2009.

European Search Report for Application No. 11153284.2, mailed Aug. 24, 2011.

* cited by examiner

INTEGRATED FUEL DELIVERY MODULE AND METHODS OF MANUFACTURE

BACKGROUND

The embodiments described herein relate to fuel system components, and more particularly, to an integrated fuel delivery module including a fuel pump and a fuel filter.

Some known fuel systems utilize a high pressure fuel pump mounted within the fuel tank of a vehicle. Some known fuel systems include a fuel delivery module, which is a package of related fuel system components that can be mounted within the fuel tank. Such known fuel delivery modules can include, for example, the fuel pump, a fuel pressure regulator, a fuel filter, and/or a fuel level sensor.

Known fuel delivery modules typically use a low-cost, non-positive displacement pump such as, for example, a turbine pump. Such pumps are often mounted at or near tank bottom due to their limited ability to produce suction. As a result, the use of such pumps can limit the locations within the fuel system and/or fuel tank where the fuel delivery module can be positioned. Additionally, some known fuel systems, such as, for example, fuel systems for off-highway vehicles can have unique and/or irregularly shaped fuel tanks that are customized for their specific applications. Accordingly, the fuel delivery module for such applications is often customized for a specific fuel tank. Thus, a need exists for an improved fuel delivery module that can be standardized to fit within a range of different tanks. A need also exists for an improved fuel delivery module in which the pump need not be on or near the tank bottom.

Further, in some known fuel systems, the fuel delivery module is removed from the fuel tank to service and/or replace one of the fuel system components therein (e.g., the fuel filter). In some arrangements, removal of the fuel delivery module and/or a portion of the fuel delivery module can cause one or more fuel flow paths to be disconnected. For example, in some known fuel systems, replacement of the fuel filter is accomplished by disconnecting the flow path from the fuel pump to the fuel filter. The removal of the fuel delivery module from the fuel tank and/or the disconnection of fuel flow paths can result in increased service times (and costs), an increased risk of potential leaks when the fuel system is reassembled and/or the use of additional parts (e.g., seals). Thus, a need also exists for improved apparatus and methods for servicing components within a fuel delivery module without requiring the removal of the fuel delivery module from the fuel tank.

SUMMARY

Fuel delivery modules are described herein. In some embodiments, a fuel delivery module includes a housing defining a first cavity containing a pump, a second cavity containing a filter and a lumen configured to provide fluid communication between the first cavity and the second cavity. The housing has a first end portion configured to be disposed within a fluid reservoir and a second end portion including a flange configured to be disposed outside of and coupled to the fluid reservoir. A surface of the first end portion defines a first opening in fluid communication with the first cavity. A surface of the second end portion defines a second opening in fluid communication with the second cavity. A cover is configured to be removably coupled to the second end portion of the housing about the second opening such that the filter can be removed from the second cavity when the flange is coupled to the fluid reservoir.

DETAILED DESCRIPTION

Figure 1:
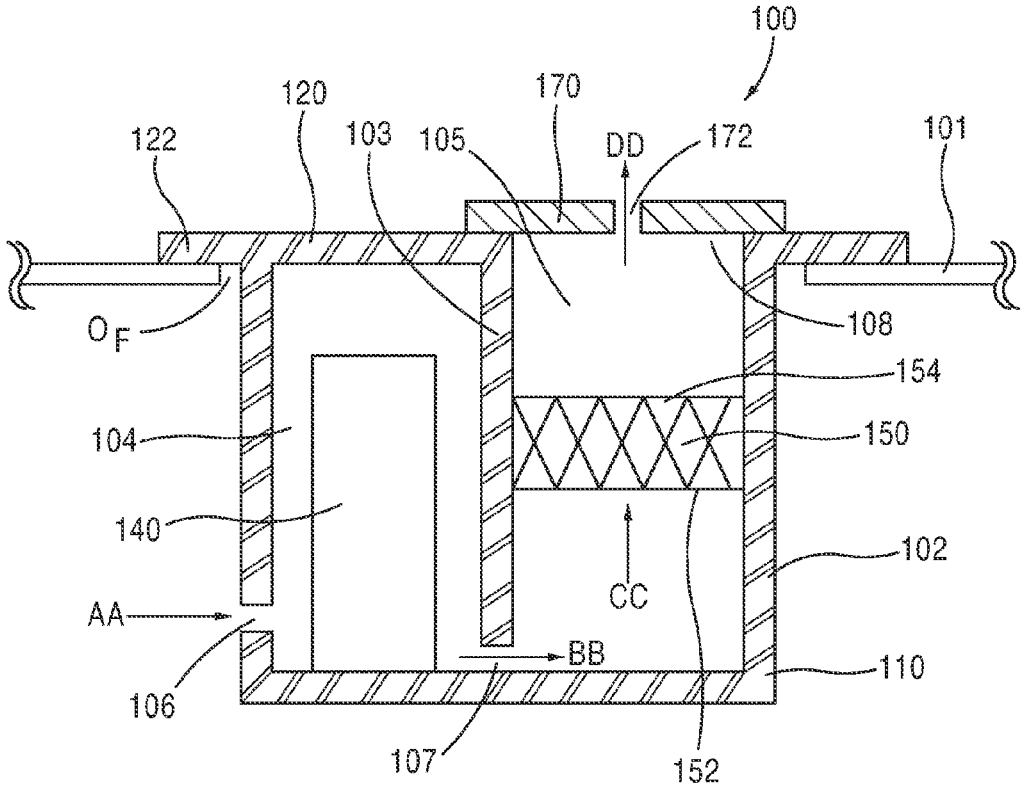
FIG. 1 is a schematic illustration of a fluid delivery module according to an embodiment.

Integrated fluid delivery modules having increased adaptability and accessibility are described herein. In some embodiments, a fluid delivery module, such as a fuel delivery module of a fuel system, includes a housing, a pump, a filter, and a cover. The housing defines a first cavity, a second cavity and a lumen configured to provide fluid communication between the first cavity and the second cavity. The pump, which can be a positive displacement pump, is disposed within the first cavity, and the filter is disposed within the second cavity. The housing has a first end portion configured to be disposed within a fluid reservoir and a second end portion that includes a flange. The flange is configured to be disposed outside of and coupled to the fluid reservoir. The fluid reservoir can be any suitable fluid reservoir, such as, for example, an oil tank. A surface of the first end portion of the housing defines a first opening in fluid communication with the first cavity. Similarly, a surface of the second end portion of the housing defines a second opening in fluid communication with the second cavity. The cover is configured to be removably coupled to the second end portion of the housing about the second opening. In this manner, the filter can be removed from the second cavity when the flange is coupled to the fluid reservoir. In some embodiments, the housing can define a third opening at the first end portion of the housing and a fourth opening at the second end portion of the housing. In some such embodiments, the third opening and the fourth opening are each in fluid communication with the lumen.

In some embodiments, a fluid delivery module includes a housing, a pump and a filter. The housing defines a first cavity, a second cavity and a lumen configured to provide fluid communication between the first cavity and the second cavity. The filter is disposed within the second cavity. A first end portion of the housing is configured to be disposed within a fluid reservoir. A second end portion of the housing is configured to be disposed outside of and coupled to the fluid reservoir when the first end portion of the housing is within the fluid reservoir. A first surface of the first end portion of the housing defines a first opening in fluid communication with the first cavity. A second surface of the second end portion of the housing defines a second opening in fluid communication with the second cavity. The second surface of the second end portion is substantially parallel to the first surface of the first end portion. The pump, which is disposed within the first cavity, includes a pump housing and at least one pumping element that is movably disposed within the pump housing. The pump housing is fixedly coupled within the first cavity of the housing such that an inlet opening defined by the pump housing is at least partially aligned with the first opening. In some embodiments, the fuel delivery module can also include a cover coupled to the second end portion of the housing about the second opening. In some such embodiments, the cover can be configured to be removed from the housing such that the filter can be removed from the second cavity when the flange is coupled to the fluid reservoir.

In some embodiments, an apparatus, such as a fuel delivery module, includes a housing, a pump, a filter, and a cover. The housing defines a first cavity, a second cavity and a lumen configured to provide fluid communication between the first cavity and the second cavity. The filter is disposed within the second cavity. A surface of a first end portion of the housing defines a first opening in fluid communication with the first cavity and a second opening in fluid communication with the second cavity. The pump, which is disposed within the first cavity, includes a pump housing and at least one pumping element that is movably disposed within the pump housing. The pump housing is fixedly coupled within the first cavity of the housing such that an inlet opening defined by the pump housing is at least partially aligned with the first opening. The cover, which is configured to be coupled to the first end portion of the housing, defines a bypass lumen and a regulator cavity. The bypass lumen is configured to be in fluid communication with the first opening of the housing and the regulator cavity is configured to be in fluid communication with the bypass lumen.

In some embodiments, a method includes disposing a pump into a cavity defined by a housing. The housing has a first end portion configured to be disposed within a fluid reservoir and a second end portion that includes a flange. The flange is configured to be disposed outside of and coupled to the fluid reservoir when the first end portion of the housing is disposed within the fluid reservoir. A surface of the first end portion of the housing defines a first opening in fluid communication with the cavity. A surface of the second end portion of the housing defines a second opening in fluid communication with the cavity. The pump is disposed into the cavity via the second opening. A motor is disposed into the cavity via the second opening such that a shaft of the motor is operably coupled to the pump. A cover is coupled to the second end portion of the housing such that the motor is electrically coupled to an electrical connector of the cover.

In some embodiments, a fluid delivery module has a compact design that can be adapted for use in a wide variety of fluid reservoirs (e.g., fuel tanks). For example, the fluid delivery module can be adapted for use in various different applications by making minor modifications, such as changing the suction tube to conform with a particular reservoir. Thus, the use of a fluid delivery module in a particular application can result in lower engineering costs and/or tooling costs. Additionally, use of the fluid delivery module in a vehicular system can reduce the time it takes to bring the system to market.

FIG. 1 is a schematic illustration of a fluid delivery module 100 according to an embodiment. The fluid delivery module 100 is coupled to a fluid reservoir 101 configured to contain a fluid (not shown). More specifically, the fluid delivery module 100 is disposed within an opening $O_F$ defined by the fluid reservoir 101, as described herein. The fluid delivery module 100 is configured to convey the fluid (not shown) from the fluid reservoir 101 to a location outside the fluid reservoir 101 as described herein. The fluid delivery module 100 includes a housing 102, a pump 140, a filter media 150 and a cover 170. The housing 102 includes a first end portion 110 and a second end portion 120, and defines a first cavity 104 and a second cavity 105. The first cavity 104 is substantially separated from the second cavity 105 via a side wall (e.g., side wall 103) of the housing 102. In some embodiments, however, the first cavity 104 and the second cavity 105 can be separated by any structure, such as, for example, a sealing ring, a sealing plate and/or the like. The first cavity 104 is in fluid communication with the second cavity 105 via an opening 107 defined by the side wall 103. In this manner, fluid from the first cavity 104 can flow through the opening 107 and into the second cavity 105, as shown by the arrow BB in FIG. 1. Although the first cavity 104 and the second cavity 105 are illustrated as having substantially the same size and shape, in other embodiments, the first cavity 104 and/or the second cavity 105 can have any suitable size and/or shape. Additionally, although the first cavity 104 and the second cavity 105 are illustrated as being positioned side-by-side, in other embodiments, the first cavity 104 can be located in any position and/or orientation relative to the second cavity 105.

As shown in FIG. 1, the pump 140 is disposed within the first cavity 104. More specifically, the first cavity 104 substantially encloses the pump 140 within the housing 102. The pump 140 can be any suitable mechanism for producing a pressure and/or fluid flow within the fluid delivery module 100 as described herein. In some embodiments, the pump 140 can be a positive displacement pump such as a gear pump, a vane pump, a piston pump or the like.

The filter media 150, which has a first end 152 and a second end 154, is disposed within the second cavity 105. As described herein, the fluid from the second cavity 105 can flow into the first end 152 of the filter media 150, as shown by the arrow CC in FIG. 1, and out of the second end 154 of the filter media 150. The filter media 150 can be any suitable filter media, such as, for example, paper, fiberglass or the like. In some embodiments, the filter media 150 and a portion of a surface (not identified) of the second cavity 105 can form a substantially fluid-tight seal such that fluid cannot flow between the surface and the filter media 150. In such embodiments, substantially all of the fluid flowing through the second cavity 105 flows through the filter media 150, and does not flow (or leak) between the filter media 150 and the side wall 103.

The first end portion 110 of the housing 102 is disposed within the fluid reservoir 101. The first end portion 110 of the housing 102 defines an inlet 106 configured to fluidically couple the first cavity 104 to the fluid reservoir 101. In this manner, fluid from the fluid reservoir 101 can flow into the first cavity 104, as shown by the arrow AA in FIG. 1. In some embodiments, the inlet 106 can be connected to a fluid intake or suction line (not shown) configured to convey fluid from a remote portion of the fluid reservoir 101 to the inlet 106. In some embodiments, the inlet 106 can include a check valve to prevent flow in a direction opposite the direction shown by the arrow AA.

At least a second end portion 120 of the housing 102 is disposed outside of the fluid reservoir 101 when the first end portion 110 of the housing 102 is disposed within the fluid reservoir 101. In this manner, the second cavity 105 is accessible from outside of the fluid reservoir 101 via an opening 108 when the first end portion 110 of the housing 102 is disposed within the fluid reservoir 101. Said another way, the opening 108 defined by the second end portion 120 is configured to fluidically couple the second cavity 105 to a region outside of the fluid reservoir 101. More particularly, the filter media 150 disposed within the second cavity 105 can be removed, replaced, recharged, and/or repaired from outside of the fluid reservoir 101 via the opening 108 when the first end portion 110 of the housing 102 is disposed within the fluid reservoir 101. In this manner, the fluid delivery module 100 can remain within and/or coupled to the fluid reservoir 101 while maintenance related to the filter media 150 is being conducted. In some embodiments, the filter media 150 can be removed from the second cavity 105 of the housing 102 for maintenance via the opening 108 without the housing 102 being moved relative to the fluid reservoir 101 (e.g., removed, repositioned or the like). As a result, the fluid delivery module 100 provides a user with access to components disposed within the second cavity 105 of the housing 102. This arrangement can be beneficial when the components (e.g., the filter media 150) disposed within the housing 102 have limited service life and/or need to be recharged, serviced or evaluated periodically.

The second end portion 120 of the housing 102 includes a flange 122. The flange 122 is disposed outside of and coupled to the fluid reservoir 101. When the flange 122 is coupled to the fluid reservoir 101, the first end portion 110 of the housing 102 is disposed within the fluid reservoir 101. The flange 122 can be coupled to the fluid reservoir 101 in any suitable manner, such as, for example, by a bolted connection, a threaded connection, by a snap-ring, or the like. In some embodiments, the flange 122 and a portion of the fluid reservoir 101 can form a substantially fluid-tight seal. Similarly stated, in some embodiments, the flange 122 and a portion of the fluid reservoir 101 can form a seal that substantially prevents a liquid and/or gas from being conveyed from within the fluid reservoir 101 to a region outside of the fluid reservoir 101. In some embodiments, the flange 122 and a portion of the fluid reservoir 101 can form a substantially hermetic seal.

Although at least a second end portion 120 of the housing 102 is illustrated and described above as being disposed outside of the fluid reservoir 101 when the first end portion 110 of the housing 102 is disposed within the fluid reservoir 101, in other embodiments, the second end portion 120 of the housing 102 can be flush with a surface of the fluid reservoir 101 or recessed beneath the surface of the fluid reservoir 101 when the first end portion 110 of the housing 102 is disposed within the fluid reservoir 101. In either the flushed or recessed arrangement, the filter media 150 disposed within the second cavity 105 can be removed, replaced and/or repaired from outside of the fluid reservoir 101 when the first end portion 110 of the housing 102 is disposed within the fluid reservoir 101.

The cover 170 is removably coupled to the second end portion 120 of the housing 102. Similarly stated, the cover 170 is coupled to the second end portion 120 of the housing 102 in a manner configured to allow the cover to be repeatedly removed and recoupled to the second end portion 120 of the housing 102. In this manner, the cover 170 can be removed from the second end portion 120 of the housing 102 when the housing 102 is coupled to the fluid reservoir 101 to allow the second cavity 105 to be accessed from a region outside of the fluid reservoir 101. Similarly stated, the cover 170 can be removed from the second end portion 120 of the housing 102 to allow the filter media 150 to be serviced and/or replaced as described above. As shown in FIG. 1, the cover 170 substantially encloses the second cavity 105 when the cover 170 is coupled to the second end portion 120 of the housing 102. Said another way, the cover 170 substantially encloses the filter media 150 within the second cavity 105 when the cover 170 is coupled to the second end portion 120 of the housing 102. The cover 170 can be coupled to the second end portion 120 of the housing 102 in any suitable manner, such as for example, by a bolted joint connection, a snap ring, a threaded coupling, an interference fit and/or the like.

The cover 170 defines an outlet 172 configured to fluidically couple the second cavity 105 to a region outside of the fluid reservoir 101. In this manner, fluid from the second cavity 105 can flow through the outlet 172 to a region outside of the fluid reservoir 101, as shown by the arrow DD in FIG. 1. In some embodiments, the outlet 172 can be connected to a fluid line (not shown) configured to convey fluid from the second cavity 105 to, for example, an engine (not shown). In some embodiments, the outlet 172 can include a check valve to prevent flow in a direction opposite the direction shown by the arrow DD.

In use, fluid from the fluid reservoir 101 is conveyed through the inlet 106 of the first end portion 110 of the housing 102 and into the first cavity 104, as shown by the arrow AA. More specifically, the pump 140 disposed within the first cavity 104 produces a vacuum that draws the fluid from the fluid reservoir 101 into the first cavity 104 via the inlet 106. The fluid in the first cavity 104 can be referred to as "unfiltered fluid." In some embodiments, however, the pump 140 and/or the inlet 106 may include an inlet filter. The unfiltered fluid is then conveyed through the opening 107 and into the second cavity 105, as shown by the arrow BB. The unfiltered fluid moves through the filter media 150 disposed within the second cavity 105, as shown by arrow CC. More specifically, the unfiltered fuel enters the filter media 150 via the first end 152, moves through the filter media 150, and exits the filter media 150 via the second end 154. In this manner, the fluid exiting the second end 154 of the filter media 150 is considered "filtered fluid." The filtered fluid within the second cavity 105 is conveyed through the outlet 172 defined by the cover 170, as shown by arrow DD. In this manner, the fluid delivery module 100 provides filtered fluid to a region outside the fluid reservoir 101. In some embodiments, the fluid delivery module can provide filtered fluid (e.g., fuel or oil) to an engine disposed outside of the fluid reservoir 101.

Although the cover 170 is shown and described as being removably coupled to the housing 102 to allow access to the second cavity 105, in other embodiments the fluid delivery module 100 can include a cover that is coupled to the housing 102 to allow access to the first cavity 104, and the fuel pump 140 disposed therein. In some embodiments, for example, a fuel delivery module can include a single cover that at least partially encloses both the first cavity and the second cavity.

FIGS. 2-12 show a fuel delivery module 200 according to an embodiment. The fuel delivery module 200 is configured to be coupled to and/or mounted on a fuel tank (not shown) containing a fuel, such as gasoline or diesel fuel. The fuel delivery module 200 can be, for example, mounted to the top, the side, or the bottom of the fuel tank. The fuel delivery module 200 is configured to convey the fuel from within the fuel tank to a location outside of the fuel tank, as described herein. The fuel delivery module 200 includes a housing 202, a fuel pump assembly 240, a regulator 215, a filter 250, a filter cover 260 and a pump cover 280. The housing 202 includes a first end portion 210 configured to be disposed within the fuel tank, a second end portion 220 at least a portion of which is configured to be disposed outside of the fuel tank, and a sidewall 203. Although the housing 202 is illustrated has having a substantially cylindrical shape, in other embodiments, the housing 202 can have any suitable shape and/or size configured to facilitate disposal of the fuel delivery module 200 into within the fuel tank.

Figure 5:
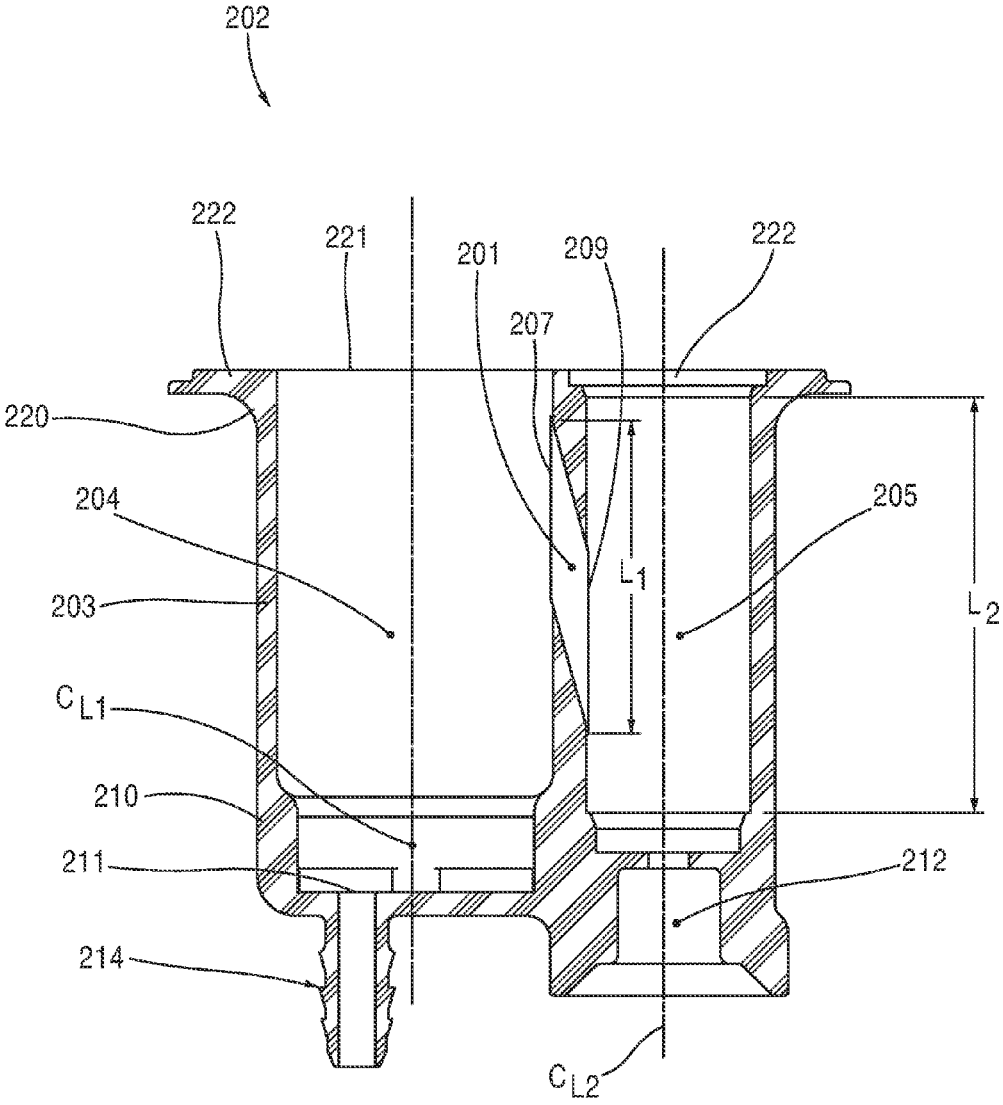
FIG. 5 is a cross-sectional view of a housing of the fuel delivery module shown in FIG. 2.

As shown in FIG. 5, which is a cross-sectional view of the housing 202, the side wall 203 of the housing 202 defines a first cavity 204 defining a center line $C_{L1}$ and a second cavity 205 defining a center line $C_{L2}$. The first cavity 204 is disposed adjacent to and substantially separated from the second cavity 205. More particularly, the first cavity 204 and the second cavity 205 are positioned side-by-side within the housing 202 such that the center line $C_{L1}$ is substantially parallel to and offset from the center line $C_{L2}$. In this manner, a portion of the side wall 203 is disposed between and/or separates the first cavity 204 and the second cavity 205. Similarly stated, the boundary of the first cavity 204 and the boundary of the second cavity 205 are noncontiguous. In other embodiments, however, at least a portion of the boundary of the first cavity 204 can be contiguous with at least a portion of the boundary of the second cavity 205. Additionally, in some embodiments, the first cavity 204 can be located in any position and/or orientation relative to the second cavity 205. For example, in some embodiments, the center line $C_{L1}$ can be nonparallel to the center line $C_{L2}$.

The first cavity 204, which contains the fuel pump assembly 240, has a size substantially greater than the size of the second cavity 205, which contains the filter 250. In some embodiments, however, the first cavity 204 and/or the second cavity 205 can have any suitable size. For example, in some embodiments, the second cavity 205 can have a greater size than the size of the first cavity 204. Although the first cavity 204 and the second cavity 205 are illustrated as having a substantially cylindrical shape, in other embodiments, the first cavity 204 and/or the second cavity 205 can have any suitable shape and/or size that accommodates the size and/or shape of their respective internal components.

The side wall 203 of the housing 202 defines a lumen 201 disposed between the first cavity 204 and the second cavity 205. More particularly, the portion of the side wall 203 that separates the first cavity 204 from the second cavity 205 defines an opening 207 and an opening 209, each in fluid communication with the lumen 201. Thus, the first cavity 204 is in fluid communication with the second cavity 205 via the lumen 201 and openings 207 and 209. In this manner, fuel disposed within the first cavity can flow through the lumen 201, via the opening 207, and into the second cavity 205, via the opening 209, as shown by arrow GG in FIGS. 3 and 12. As shown in FIG. 5, the lumen 201 defined by the side wall 203 is disposed at an angle between the first cavity 204 and the second cavity 205. Said another way, an angle defined by a center line the lumen 201 and the center line $C_{L1}$ (or the center line $C_{L2}$) is between 0 and 90 degrees. Thus, the lumen 201 extends from a portion of the first cavity 204 defined by the second end portion 220 of the housing 202 to the a portion of the second cavity 205 defined by the first end portion 210 of the housing 202. In some embodiments, the opening 207 is defined by the second end portion 220 of the housing 202 and the opening 209 is defined by the first end portion 210 of the housing 202.

Because the lumen 201 extends between the first end portion 210 of the housing 202 and the second end portion 220 of the housing 202, a length $L_1$ of the lumen 201 is at least half a length $L_2$ of the second cavity 205. In other embodiments, however, the lumen 201 can have any suitable length. For example, in some embodiments, the lumen 201 can have a length less than half the length of the second cavity 205. The lumen 201 can have any suitable diameter along the length of the lumen 201 to facilitate the conveyance of fuel and/or other fluids from the first cavity 204 to the second cavity 205.

As discussed above, the first end portion 210 of the housing 202 is configured to be disposed within the fuel tank. The first end portion 210 of the housing 202 defines an inlet opening 211 and a regulator cavity 212, and includes an inlet fitting 214. The inlet opening 211, which is disposed on lower surface of the side wall 203 (below the first cavity 204 as shown in FIG. 5), provides fluid communication between the first cavity 204 and the fuel tank, as described herein. The inlet fitting 214, which is in fluid communication with and/or defines a portion of the inlet opening, can be coupled to a fuel line 213 (shown in FIG. 2). The fuel line 213 can be any suitable fuel line configured to convey fuel from the fuel tank to the inlet 211, as shown by the arrow EE in FIGS. 3. In some embodiments, the fuel line 213 can be a rubber hose, a thermoplastic tubing (e.g., polyamide tubing, PTFE tubing, or the like), a hose containing a metallic braid, a composite fuel line, or the like. In some embodiments, the fuel line 213 is removably coupled to the inlet fitting 214 via the series of barbs on the exterior of the inlet fitting 214. In this manner, the fuel line 213 can be replaced or altered depending on the type of tank within which the fuel delivery module 200 is disposed. As such, the fuel delivery module 200 can be used within a variety of different tanks by changing the fuel line 213. In some embodiments, the fitting 214 can include a check valve to prevent flow in a direction opposite the direction shown by the arrow EE.

Figure 6:
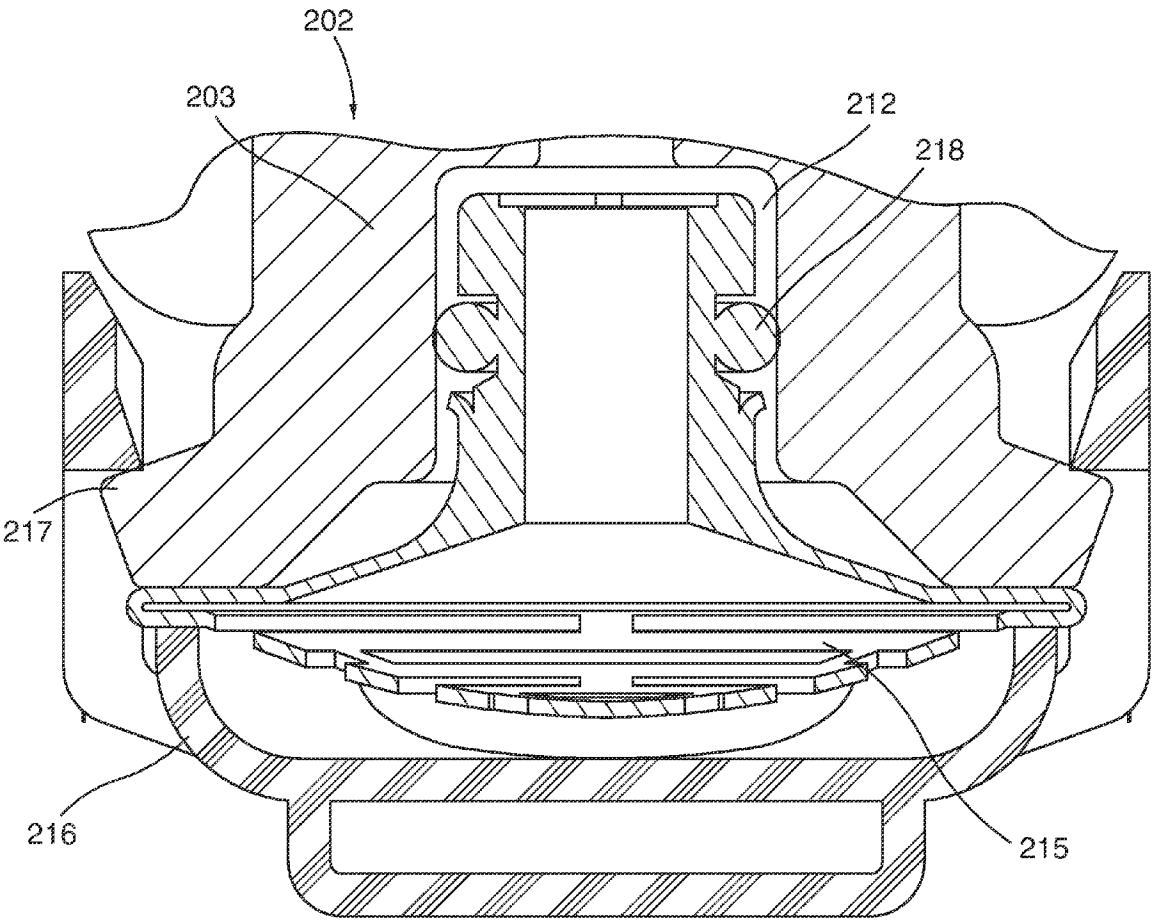
FIG. 6 is an enlarged cross-sectional view of the portion of the fuel delivery module shown in FIG. 2 labeled as region Z in FIG. 12.
Figure 12:
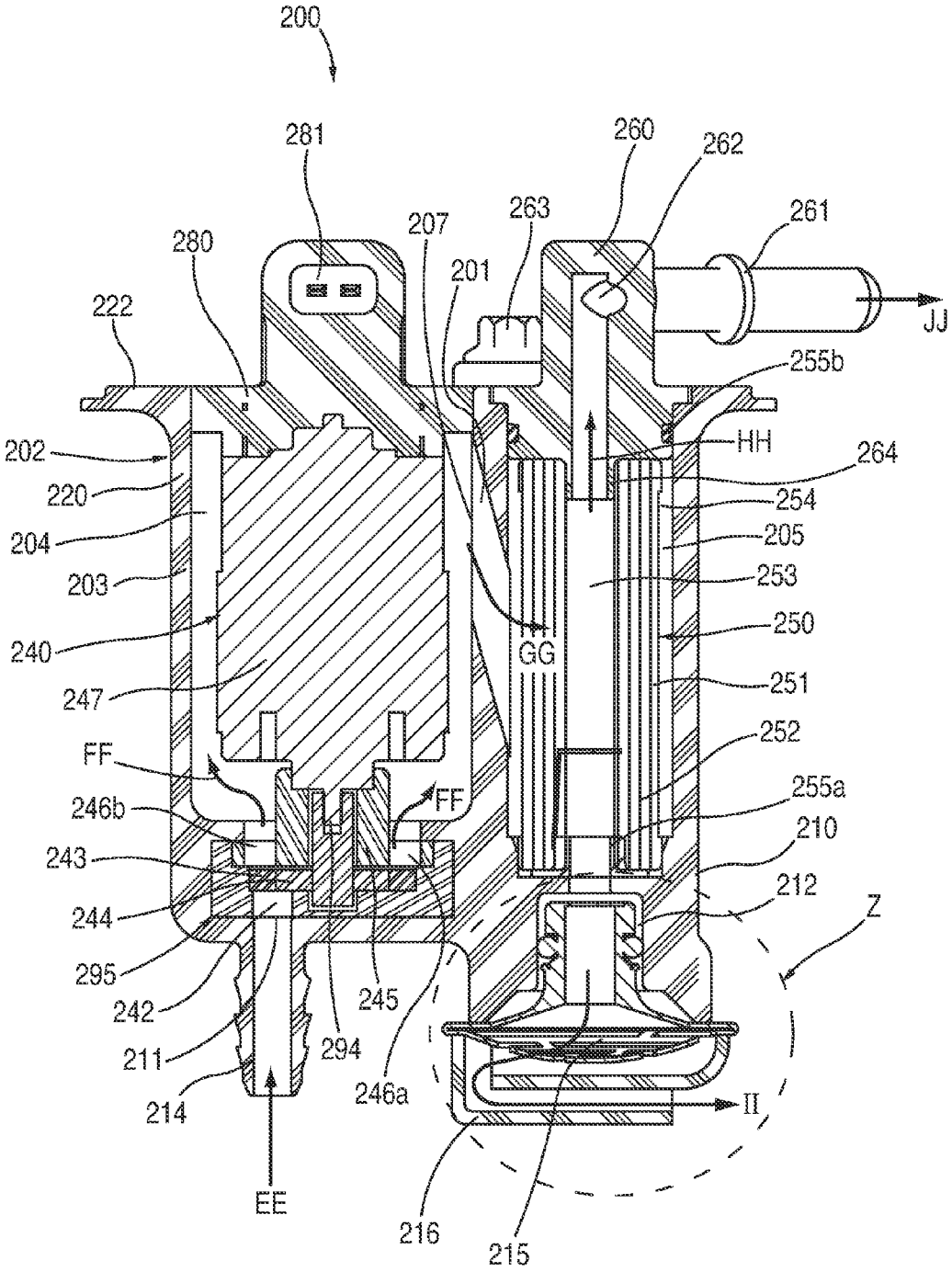
FIG. 12 is a cross-sectional view of the fuel delivery module shown in FIG. 2.

As shown in FIG. 6, which is an enlarged view of the portion of the fuel delivery module 200 identified as region Z in FIG. 12, the regulator 215 is coupled to the first end portion 210 of the housing 202 by a regulator clip 216, which matingly engages a protrusion 217 of the first end portion 210 of the housing 202. When the regulator 215 is coupled to the first end portion 210 of the housing 202, a portion of the regulator 215 is disposed within and in fluid communication with the regulator cavity 212 (see e.g., FIGS. 5, 6 and 12). An o-ring 218 is coupled to the portion of the regulator 215 and engages a portion of the side wall 203 to form a substantially fluid-tight seal within the regulator cavity 212. The regulator cavity 212 is in fluid communication with the second cavity 205. In this manner, the regulator 215 is fluidically coupled to the second cavity 205 via the regulator cavity 212.

The regulator 215 can be any suitable regulator for regulating a fuel pressure and/or a fuel flow within the second cavity 205. For example, in some embodiments, the regulator 215 can be a flow-through regulator configured to selectively provide a flow path from the regulator cavity 212 to the fuel tank (i.e., a return flow path) to regulate the flow and/or pressure of the fuel within the second cavity 205. In some embodiments, the regulator 215 can be a commercially-available fuel regulator, such as, for example, any one of the "Micra Flow Through" regulators produced by the Continental Automotive Group. Although the regulator 215 is shown as being a "contained" regulator having the regulating components (e.g., valve element, spring(s), valve seat, etc.) packaged within a regulator housing that is disposed within the regulator cavity 212, in other embodiments, a fuel delivery module can include a regulator that is assembled within the regulator cavity 212 the housing 202.

The second end portion 220 of the housing 202 includes a flange 222 and defines a first opening 221 and a second opening 223. The first opening 221 defined by the second end portion 220 is in fluid communication with the first cavity 204 (see e.g., FIG. 5). In this manner, the first cavity 204 can be accessible from outside the fuel tank via the first opening 221, as described below. Similarly, the second opening 223 defined by the second end portion 220 is in fluid communication with the second cavity 205 (see e.g., FIG. 5). In this manner, the second cavity 205 can be accessible from outside the fuel tank via the second opening 223.

The flange 222 is configured to be disposed outside of and coupled to the fuel tank such that the first end portion 210 of the housing 202 is within fuel tank. The flange 222 can be coupled to the fuel tank in any suitable manner, such as, for example, by a snap-ring. The flange 222 can include one or more protrusions or mounting keys (not shown) configured to maintain the orientation of the housing 202 when the housing 202 is mounted to the fuel tank. The second end portion 220 of the housing 202 can be configured to receive a seal member (e.g., an o-ring, a gasket or the like) to form a substantially fluid-tight seal between the housing 202 (e.g., the flange 222) and the fuel tank. Similarly stated, the second end portion 220 of the housing 202 (e.g., the flange 222), the fuel tank and a seal member (not shown) can form a seal that substantially prevents a liquid and/or gas from being conveyed from within the fuel tank to a region outside of the fuel tank.

The second end portion 220 of the housing 202 is configured to be disposed outside of the fuel tank when the first end portion 210 of the housing 202 is disposed within the fuel tank. In this manner, the first cavity 204 and/or the second cavity 205 can be accessed from outside of the fuel tank when the first end portion 210 of the housing 202 is disposed within the fuel tank. More particularly, any of the components (e.g., the fuel pump assembly 240) contained within the first cavity 204 can be removed, replaced, recharged, and/or repaired from outside of the fuel tank via the first opening 221. Similarly, any of the components (e.g., the filter 250) contained within the second cavity 205 can be removed, replaced, recharged, and/or repaired from outside of the fuel tank via the second opening 222. In this manner, the fuel delivery module 200 can remain within the fuel tank while maintenance related to one or more of the components contained within the first cavity 204 and/or the second cavity 205 is being conducted, as described above. In some embodiments, however, the pump cover 280 and/or the filter cover 260 can be fixedly coupled to the housing 202 (e.g., via a weld an adhesive or the like) such that the components contained within the first cavity 204 and/or the second cavity 205 cannot be accessed via the first opening 221 and/or the second opening 222.

Figure 8:
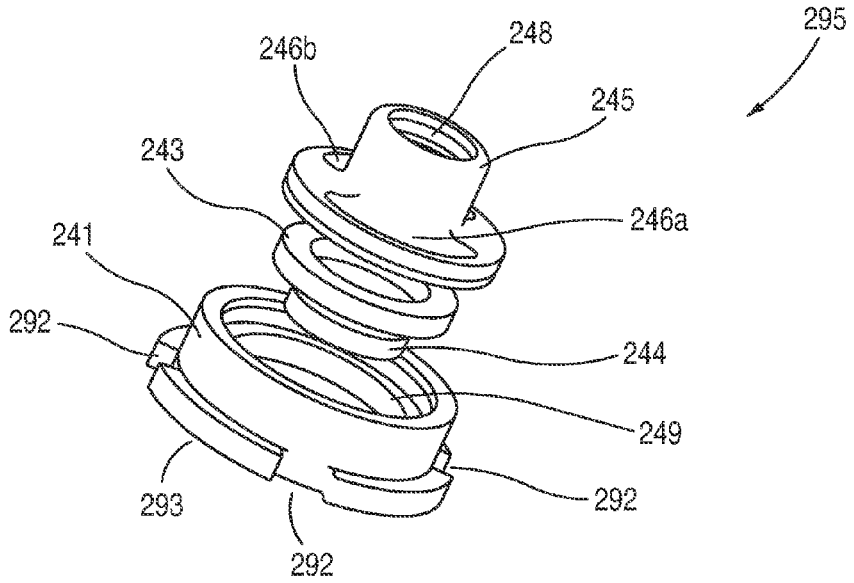
FIG. 8 is a perspective exploded view of the gerotor pumping stage shown in FIG. 7.
Figure 9:
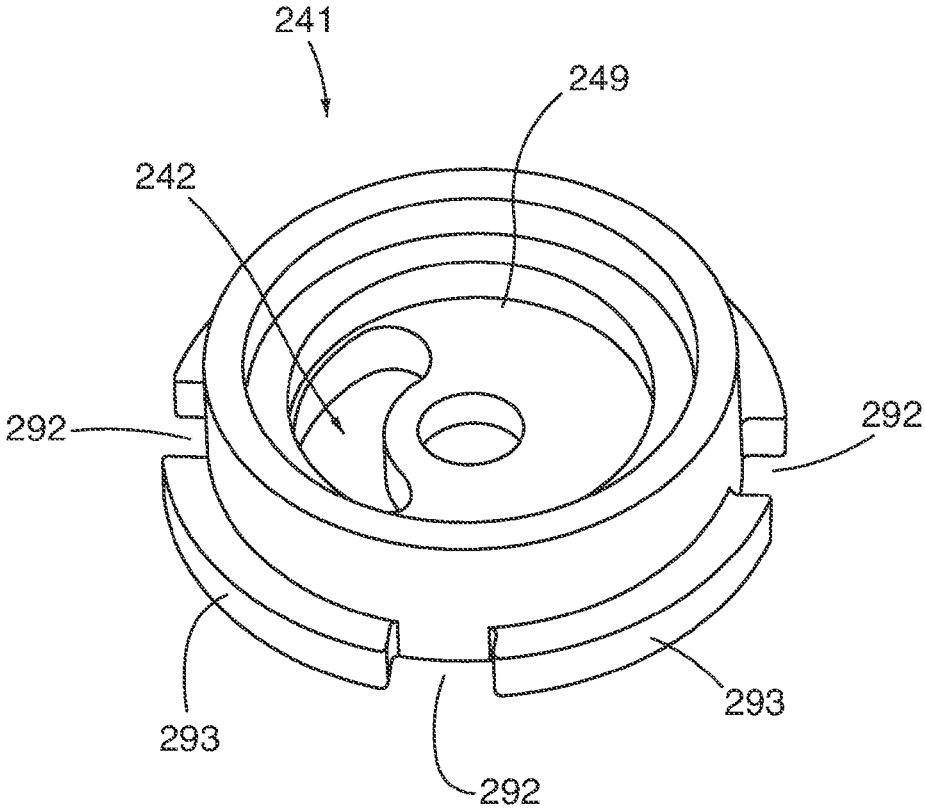
FIG. 9 is a perspective view of a portion of the gerotor pumping stage shown in FIG. 7.
Figure 10:
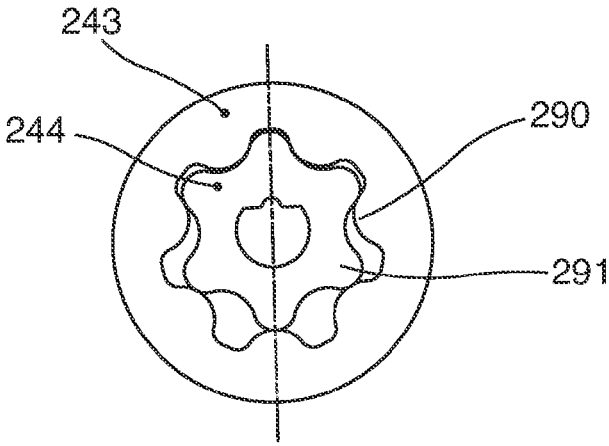
FIG. 10 is a top view of a portion of the gerotor pumping stage shown in FIG. 7.

As shown in FIGS. 4 and 7-12, the fuel pump assembly 240 includes a gerotor housing 241, an outer gerotor element 243, an inner gerotor element 244, an outlet housing 245, and a fuel pump motor 247. The gerotor housing 241, the outer gerotor element 243, the inner gerotor element 244 and the outlet housing 245 collectively form the positive displacement gerotor pumping stage 295 of the fuel delivery module 200. As shown in FIG. 10, the outer gerotor element 243 includes a number of lobes (or gear teeth) 290, and the inner gerotor element 244 includes one less lobes (or gear tooth) 291 than the outer gerotor element 243. Only one of each of the lobes 290 and 291 are labeled in FIG. 10 for clarity. The inner gerotor element 244 is disposed within the outer gerotor element 243 such that the lobes 291 of the inner gerotor element 244 are disposed between the lobes 290 of the outer gerotor element 243.

In use, the inner gerotor element 244 rotates within and with respect to the outer gerotor element 243 such that the respective lobes 290 and 291 of the gerotor elements 243 and 244 mesh together during rotation. The volume between respective lobes 290, 291 defines a series of pumping chambers for the gerotor pumping stage 295. Because there are fewer lobes 291 on the inner gerotor element 244 than lobes 290 on the outer gerotor element 243, rotation of the inner gerotor element 244 causes the volume of each pumping chamber to alternatively increase and decrease as function of angular position (i.e., during the rotation of the inner gerotor element 244 and the outer gerotor element 243). When the volume of the pumping chambers increases, a vacuum is produced to draw fuel in to the chambers (the "suction" portion of the cycle). When the volume of the pumping chambers decreases, the fuel contained therein is pressurized. The pressurized fuel is then forced out of the pumping chambers as described in more detail herein. This positive displacement pump configuration can produce a greater suction than non-positive displacement arrangements, and can therefore allow the pump inlet to be placed at any location within the fuel tank without requiring that the pump inlet be submerged in fuel.

The gerotor housing 241 defines a cavity 249 and an inlet 242 in fluid communication with the cavity 249 (see FIG. 9). The gerotor elements 243 and 244 are disposed within a cavity 249 of the gerotor housing 241 such that the gerotor elements 243 and 244 can rotate within the cavity 249 of the gerotor housing 241. The cavity 249 has a step configuration such that a bottom portion of the cavity 249 has a smaller diameter than a top portion of the cavity 249, as shown in FIG. 8. This arrangement produces an enclosure within which the gerotor elements 243 and 244 are disposed when the outlet housing 245 is coupled to and within a portion of the cavity 249.

Figure 11:
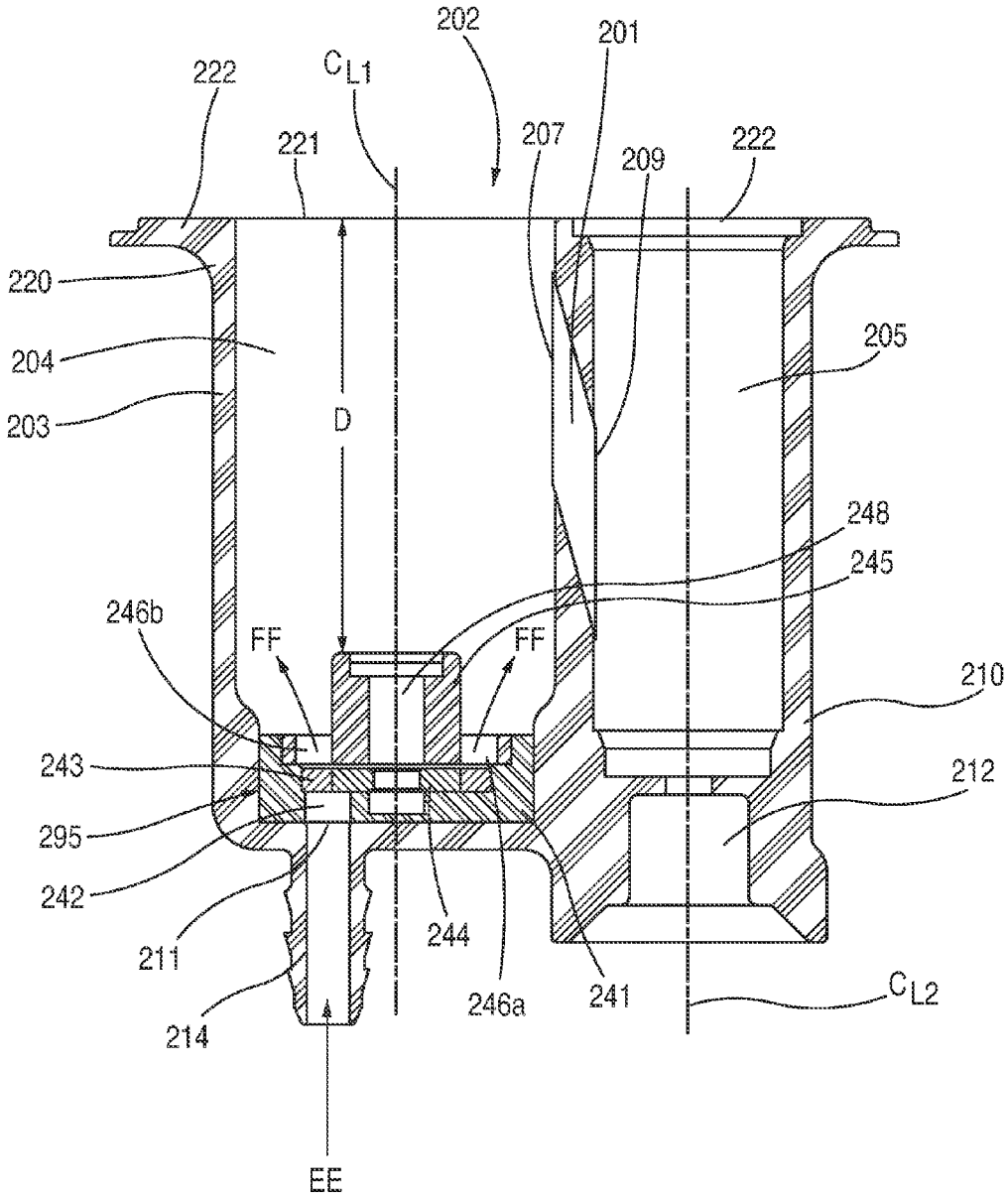
FIG. 11 is a cross-sectional view of a portion of the fuel delivery module shown in FIG. 2.

The gerotor housing 241 is disposed within first cavity 204 of the housing 202 proximate to the first end portion 210 of the housing 202 such that the inlet 242 is at least partially aligned with the inlet 211 of the first end portion 210 of the housing 202, as shown in FIG. 11. In this manner, the inlet 242 is fluidically coupled to the fuel tank to define a suction path through which fuel can be drawn from the tank into the pump assembly 240, as shown by the arrow EE in FIGS. 3 and 12.

The outer surface of the gerotor housing 241 defines a series of mounting slots or grooves 292 and protrusions 293. The gerotor housing 241 is disposed within first cavity 204 of the housing 202 such that the slots 292 receive a corresponding protrusion (not shown) of the housing 202 and/or the protrusions 293 are received within a corresponding slot (not shown) defined by the side wall 203 of the housing 202. In this manner, rotation of the gerotor housing 241 about the center line $C_{L1}$ is inhibited when the gerotor housing 241 is disposed within first cavity 204 of the housing 202. This arrangement maintains the alignment between the inlet 242 of the gerotor housing 241 and the inlet 211 of the first end portion 210 of the housing 202. The gerotor housing 241 can be coupled within the first cavity 204 by any suitable means, such as an interference fit.

The arrangement of the gerotor housing 241 within the first cavity 204 of the housing 202 also maintains the pumping stage 295 at substantially fixed distance from the flange 222. More particularly, as shown in FIG. 12, the pumping stage 295 is maintained at a distance D from the flange 222 (see FIG. 11). In this manner, when the fuel delivery module is coupled to and mounted within the fuel tank, the pumping stage 295 is at a substantially fixed distance relative to the opening defined by the fuel tank within which the first portion 210 of the housing 202 is disposed, rather than being disposed such that the pumping stage 295 is adjacent or against the bottom surface of the fuel tank. Because the pumping stage 295 is a positive displacement pump configuration the pump inlet need not be submerged in fuel. Although this arrangement allows the flexibility to use the fuel deliver module 200 in any type of fuel tank, in some embodiments, the distance D is such that the pumping stage 295 is disposed adjacent to and/or against the bottom surface of the fuel tank.

Figure 7:
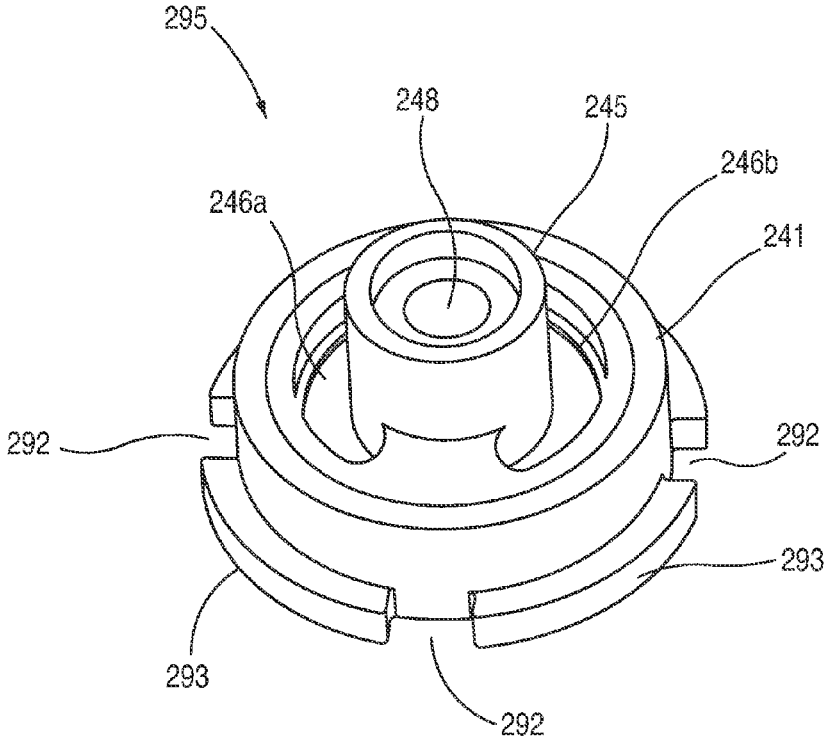
FIG. 7 is a perspective view of the gerotor pumping stage of the fuel delivery module shown in FIG. 2.

A portion of the outlet housing 245 is disposed within the top portion of the cavity 249 of the gerotor housing 241. The outlet housing 245 can be coupled to the gerotor housing 241 by any suitable means. For example, in some embodiments, the outlet housing 245 can be press-fit into the top portion of the cavity 249. The outlet housing 245 is disposed above and apart from the gerotor elements 243 and 244 to allow the gerotor elements 243 and 244 to rotate freely within the gerotor housing 241, as described above. As shown in FIGS. 7 and 8, the outlet housing 245 defines a central lumen 248 and slots 246*a* and 246*b* configured to convey pressurized fuel from the gerotor elements 243 and 244 to the first cavity 204, as shown by arrow FF in FIGS. 3, 11 and 12. Said another way, the slots 246*a* and 246*b* are configured to fluidically couple the pumping chambers defined by the gerotor elements 243 and 244, as described above, to the first cavity 204. Although the outlet housing 245 is illustrated and described as defining two outlet slots, in other embodiments, the outlet housing 245 can define any number of slots. For example, in some embodiments, the outlet housing 245 can define a single outlet slot.

The central lumen 248 extends the length of the outlet housing 245 and is configured to receive a portion of the fuel pump motor shaft 294, as shown in FIG. 12. More specifically, the fuel pump motor shaft 294 extends through the central lumen 248 and contacts the inner gerotor element 244. In this manner, the fuel pump motor 247 can provide power to move the gerotor elements 243 and 244, as described above. The fuel pump motor 247 can be any suitable pump motor, such as a commercially-available DC motor.

Figure 2:
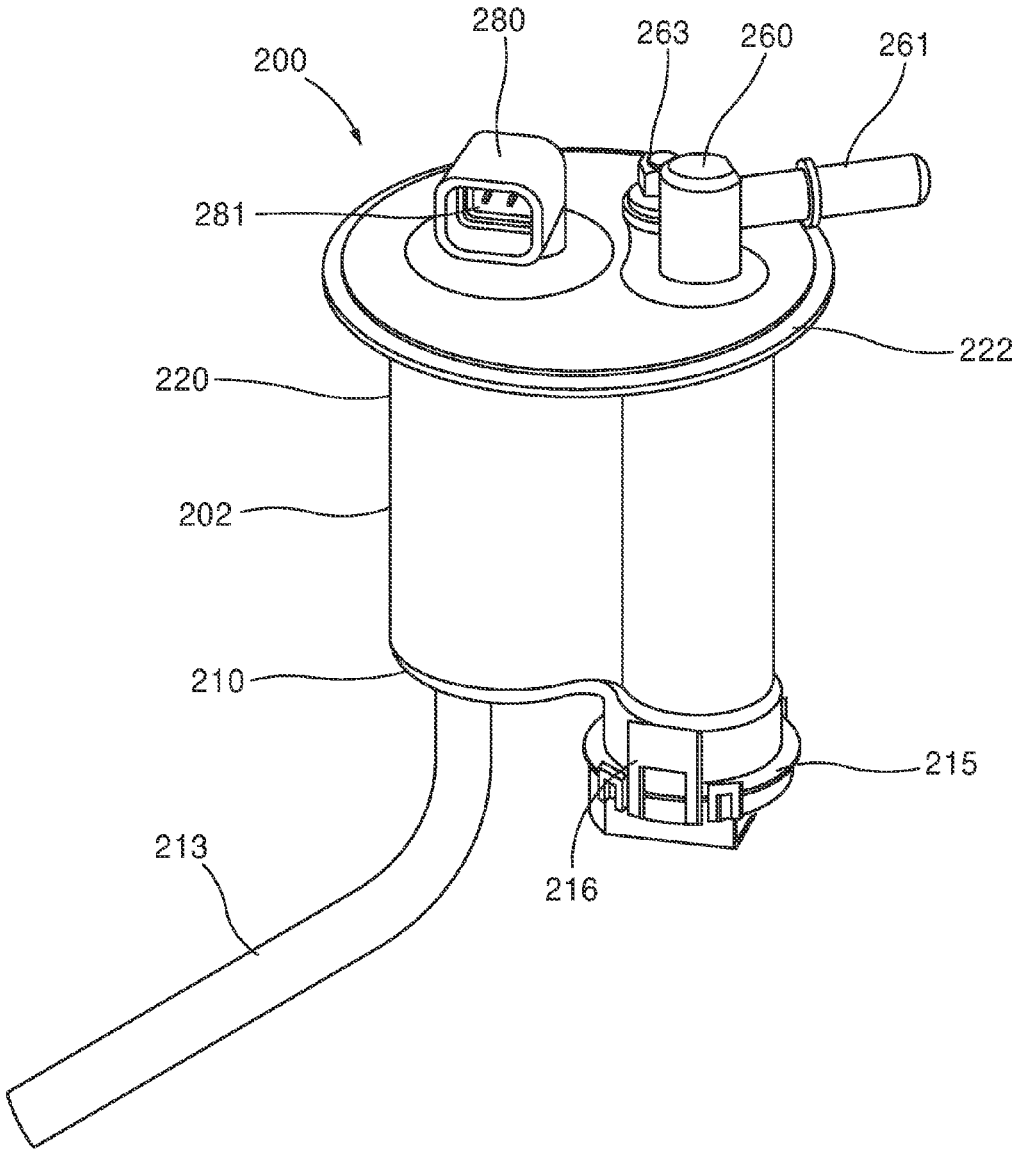
FIG. 2 is a perspective view of a fuel delivery module according to an embodiment.

The pump cover 280, which includes an electrical connector 281, is coupled to the second end portion 220 of the housing 202 about the first opening 221. When the pump cover 280 is disposed within and/or coupled about the first opening 221, a portion of the electrical connector 281 is disposed through the first opening 221 and into electrical contact with the motor 247, in this manner, the electrical connector 281 can electrically couple a power supply disposed outside of the fuel tank to the fuel pump assembly 240 disposed within the first cavity 204 (i.e., within the fuel tank). As shown in FIG. 2, the electrical connector 281 is configured to retain a corresponding connector from, for example, a vehicle wiring harness. The electrical connector 281 can include any suitable structure for coupling a power supply to the fuel pump assembly 240.

The pump cover 280 can be coupled to the cover 270 by any suitable manner, such as, for example, by screws, clips, snap rings, a threaded flange or the like. In some embodiments, however, the pump cover 280 can be fixedly coupled via a spin-welding. For example, after the fuel pump assembly 350 is disposed within the first cavity 204, the pump cover 280 can be rotated relative to the housing 202 such that the pump cover 280 and the housing 202 are coupled by a spin weld. In some embodiments, the pump cover 280 and the housing 202 can be coupled together to form a fluid-tight seal. In other embodiments, the pump cover 280 can be removably coupled to the housing 202. In this manner, the pump cover 280 can be repeatedly removed and/or replaced.

Figure 3:
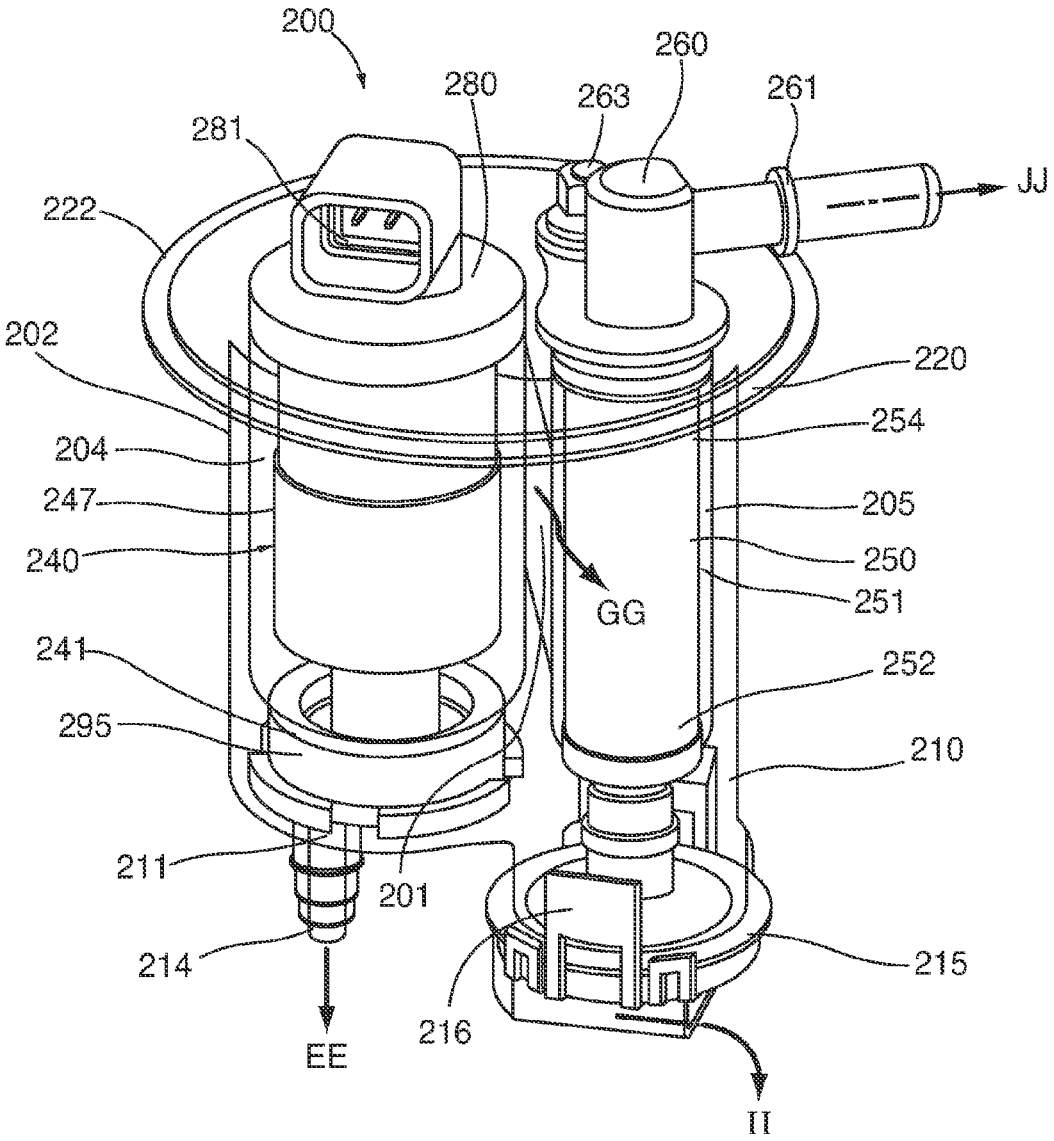
FIG. 3 is a perspective view of the fuel delivery module shown in FIG. 2, with the housing shown as being transparent.
Figure 4:
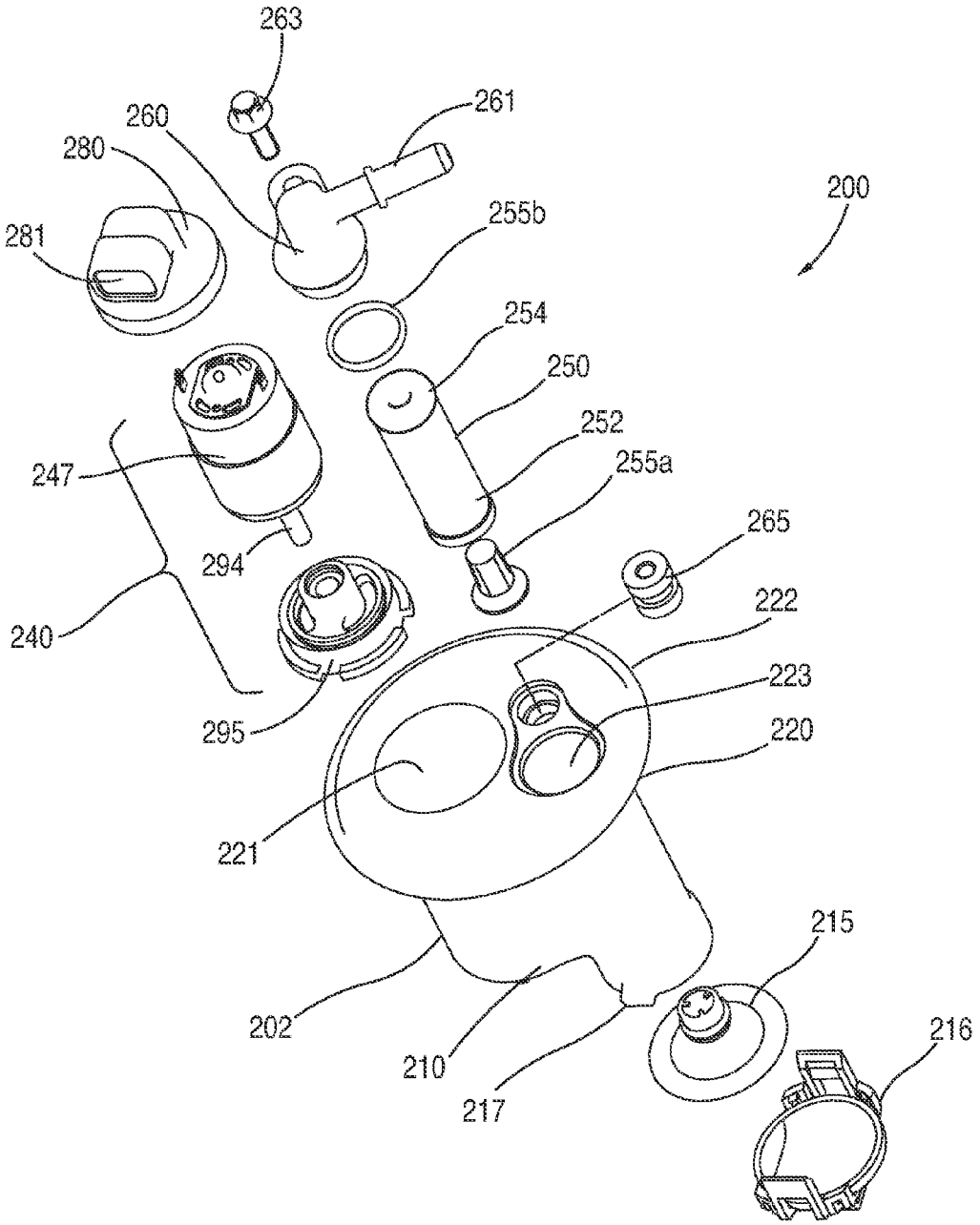
FIG. 4 is a perspective exploded view of the fuel delivery module shown in FIG. 2.

The filter 250, which is disposed within the second cavity 205 as shown in FIG. 12, includes a filter media 251 and a seal member 255*a*. In some embodiments, the filter 250 can be a commercially-available fuel filter, such as, for example, the Wix fuel filter part number 33943 produced by Affinia Group, Inc. As shown in FIGS. 3, 4 and 12, the filter media 251, which has a substantially cylindrical shape, has a first end 252 and a second end 254 and defines a lumen 253 therethrough. The filter media 251 can be any suitable filter media, such as, for example, paper, fiberglass or the like. When the filter 250 is disposed within the second cavity 205, the first end 252 of the filter media 251 is sealed against the distal-most surface of the second cavity 205 via seal member 255*a*. Similarly stated, when the filter 250 is disposed within the second cavity 205, the seal member 255*a* and the distal-most surface of the second cavity 205 form a substantially fluid-tight seal. The seal member 255*a* can be constructed from any suitable material (e.g., an elastomer) configured to form a seal (e.g., a "face seal") with a portion of the housing 202, as described above. Moreover, the filter 250 is coupled within the second cavity 205 such that the lumen 253 is substantially aligned with and/or is in fluid communication with the regulator cavity 212. In this manner, the lumen 253, within which pressurized, "filtered" fuel flows, is fluidically coupled to the regulator 215.

The filter cover 260 includes a coupling member 263, a seal member 255*b* and an elongate portion (or outlet fitting) 261, and defines a lumen 262 therethrough. The filter cover 260 is coupled to the housing 202 such that the filter cover 260 substantially encloses the second opening 223 of the housing 202. When the filter cover 260 is coupled to the housing 202, the seal member 255*b* and a portion of the housing 202 form a substantially fluid-tight seal (see e.g., FIG. 12). The seal member 255*b* can be constructed from any suitable material (e.g., an elastomer) configured to form a seal with a portion of the housing 202 and/or the filter cover 260. The seal member 255*b* can be, for example, an o-ring, a gasket or the like.

When the filter 250 is disposed within the second cavity 205, the second end 254 of the filter 250 is disposed about a protrusion 264 of the filter cover 260. Similarly stated, the protrusion 264 of the filter cover 260 can be disposed within the lumen 253 of the filter 250 to couple the filter 250 to the filter cover 260 and/or to secure the filter 250 within the second cavity 205. In some embodiments, the size of the protrusion 264 can be larger than the inner diameter of the lumen 253, thereby producing an interference fit between the protrusion 264 and the filter 250. In this manner, the filter 250 can remain coupled to the filter cover 260 when the filter cover 260 is removed from the housing 202. In some embodiments, the second end 254 of the filter 250 can include an elastomeric portion such that the second end 254 of the filter 250 and the protrusion 264 form a substantially fluid-tight seal when the protrusion 264 of the filter cover 260 is disposed within the lumen 253.

As shown in FIG. 12, the filter 250 is coupled within the second cavity 205 such that the lumen 253 is substantially aligned with the lumen 262 of the filter cover 260. In this manner, pressurized, "filtered" fuel can flow from the second cavity 205 of the housing 202 to a region outside of the fuel delivery module via the filter cover, as shown by the arrow JJ in FIGS. 3 and 12.

The filter cover 260 is coupled to the housing 202 via coupling member 263. Although the coupling member 263 is illustrated as being a screw that is threaded into an insert 265 that is pressed and/or molded into the housing 202 (see e.g., FIG. 4), in other embodiments, the coupling member 263 can be any suitable coupling member, such as, for example, a clip. Thus, the filter cover 260 can be removably coupled to the housing 202. In this manner, the filter cover 260 can be repeatedly removed and/or replaced to access the filter 250 within the second cavity 205.

In some embodiments, the elongate portion 261 can be coupled to a fuel line, which can be similar to fuel line 213, such that filtered fluid can be conveyed from the second cavity 205 to a region outside the fuel tank via the lumen 262.

The filter cover 260 and/or the pump cover 280 can be constructed from any suitable material, such as, for example, a molded plastic, a machined metal, or a stamped metal assembly. In some embodiments, the filter cover 260 and the pump cover 280 are constructed from the same material. In other embodiments, however, the filter cover 260 and the pump cover 280 are constructed from different materials. Although the pump cover 280 and the filter cover 260 are shown and described as being separate constructed covers, in other embodiments, the pump cover and the filter cover can be covered by a single piece.

In use, the fuel pump assembly 240 draws fuel in from the fuel tank through a pathway that includes the fuel line 213, the inlet fitting 214 and the inlet opening 211, as shown by arrows EE. In FIGS. 3 and 12. The fuel is drawn into the gerotor housing 241 through inlet 242, and is pressurized by the gerotor elements 243 and 244, as described above. The pressurized fuel is then conveyed from the fuel pumping stage 295 to the first cavity 204 through the slots 246*a* and 246*b* of the outlet housing 245, as indicated by the arrow FF in FIGS. 3 and 12. The pressurized fuel flows within the first cavity 204 such that the pressurized fuel passes between the pump motor 247 and the side wall 203. The fuel can advantageously be used to cool the pump motor 247 and/or lubricate the rotating components of the motor 247. The pressurized fuel is conveyed from the first cavity 204 to the second cavity 205 through the lumen 201. Said another way, the pressurized fuel is conveyed through the opening 207 and into the second cavity 205, as shown by the arrow GG in FIGS. 3 and 12. The pressurized fuel can also be referred to an "unfiltered fuel." The unfiltered fuel is then conveyed through the filter media 251 into the lumen 253. Similarly stated, unfiltered fuel is then conveyed through the filter media 251 into a "filtered portion" of the second cavity 205.

At least a first portion of the filtered fuel within lumen 253 towards the filter cover 260, as shown by the arrow HH in FIG. 12. This portion of the filtered fuel is further conveyed via the lumen 262 of the filter cover 260 to an area outside of the fuel delivery module 200 (as shown by the arrow JJ), as described above. When the pressure within the second cavity 205 exceeds a threshold, the regulator 215 provides a flow path for a second portion of the filtered fuel to return to the fuel tank, as shown by the arrow II in FIGS. 3 and 12. In this manner, the fuel delivery module 200 provides filtered fuel at a regulated pressure and/or flow rate to a region outside the fuel tank.

The fuel delivery module 200 can be used as part of any machine requiring transfer of fluid (e.g., fuel) from a fluid reservoir (e.g., fuel tank) to an engine or other fluidic device. For example, the fuel delivery module 200 can be used to convey fuel from a tank to any suitable type of engine (e.g., a 2-stroke engine or a 4-stroke engine). Although described above as being used to transfer fuel, the fuel delivery module 200 can be used to transfer oil or any other suitable fluid.

Figure 13:
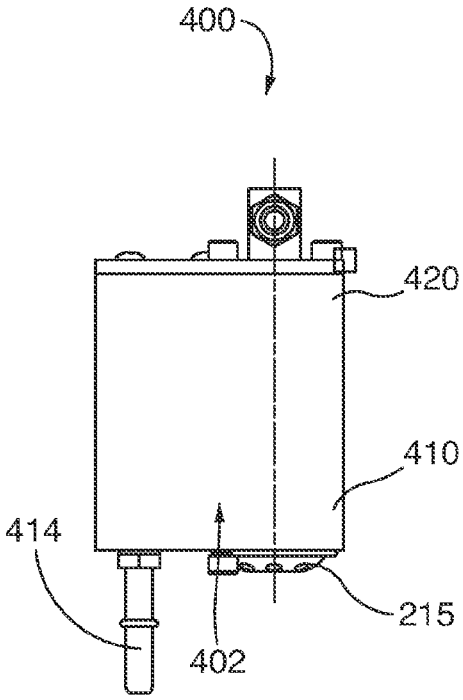
FIG. 13 is a front view of a fuel delivery module according to an embodiment.
Figure 14:
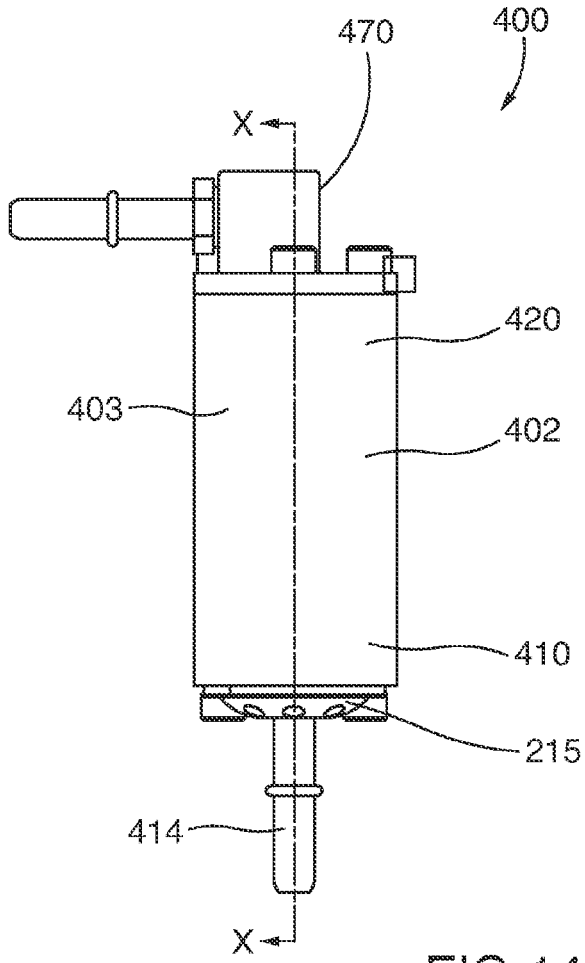
FIG. 14 is a side view of the fuel delivery module shown in FIG. 13.
Figure 15:
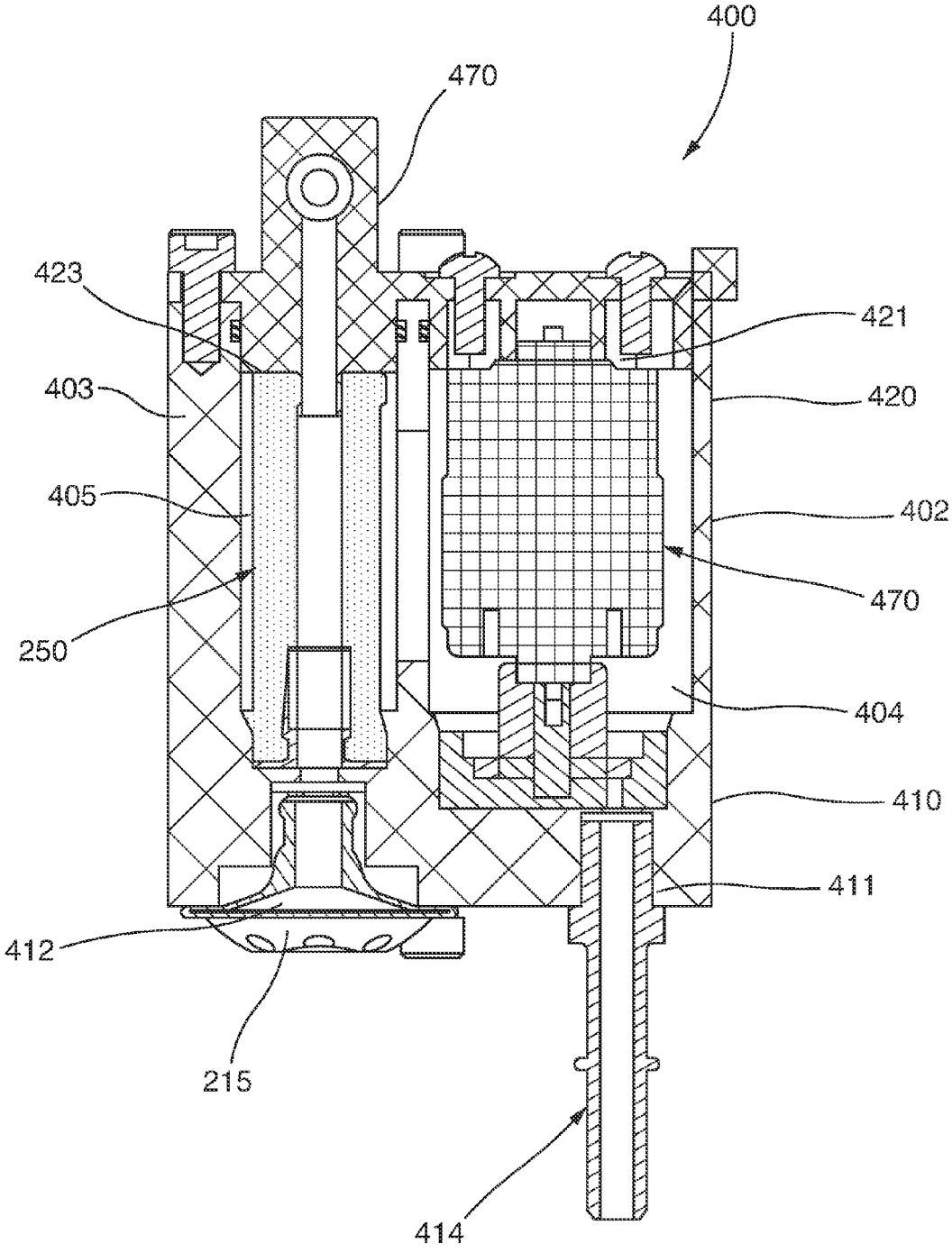
FIG. 15 is a cross-sectional view of the fuel delivery module shown in FIG. 13 taken along line X-X in FIG. 14.

Although the housing 202 is illustrated as having a substantially monolithic construction, in other embodiments, the housing can be constructed of any number of components that are, for example, coupled together to form the fuel delivery module and/or housing. For example, FIGS. 13-15 show a fuel delivery module 400 according to an embodiment. The fuel delivery module 400 includes a housing 402, a fuel pump assembly 240, a regulator 215, a filter 250 and a cover 470. The fuel delivery module 400 is similar in function to the fuel delivery module 200, and is therefore not described in detail below. In particular, the fuel pump assembly 240, the filter 250 and the regulator 215 are the same as the fuel pump assembly 240, the filter 250 and the regulator 215, respectively, described above with reference to FIGS. 2-12. The primary difference between the fuel delivery module 400 and the fuel delivery module 200 is the housing 402 and the cover 270.

The housing 402 includes a first end portion 410 configured to be disposed within the fuel tank, a second end portion 420 at least a portion of which is configured to be disposed outside of the fuel tank, and a sidewall 403. As shown in FIG. 15, which is a cross-sectional view of the housing 402, the side wall 403 of the housing 402 defines a first cavity 404 and a second cavity 405. The first cavity 404 is disposed adjacent to and substantially separated from the second cavity 405. The first cavity 404 contains the fuel pump assembly 240, and the second cavity 405 contains the filter 250.

The side wall 403 of the housing 402 defines a lumen (or passageway) 401 disposed between the first cavity 404 and the second cavity 405. Thus, the first cavity 404 is in fluid communication with the second cavity 405 via the lumen 401. In contrast to the lumen 201 defined by the housing 202 described above, the center line of the lumen 401 is substantially normal to the side wall 403. Said another way, an angle defined by a center line the lumen 401 and the center line of the first cavity 404 and/or the second cavity 405 is approximately 90 degrees.

The first end portion 410 of the housing 402 defines an inlet opening 411 and a regulator cavity 412, and includes an inlet fitting 414. In contrast to the inlet fitting 214, which is monolithically constructed as a part of the housing 202, the inlet fitting 414 is a separate member that is disposed within the inlet opening 411. The inlet fitting can be coupled to a fuel line 413, as described above.

The second end portion 420 of the housing 402 includes defines a first opening 421 and a second opening 423. The first opening 421 defined by the second end portion 420 is in fluid communication with the first cavity 404 (see e.g., FIG. 15). In this manner, the first cavity 404 can be accessible from outside the fuel tank via the first opening 421, as described below. Similarly, the second opening 423 defined by the second end portion 420 is in fluid communication with the second cavity 405 (see e.g., FIG. 15). In this manner, the second cavity 405 can be accessible from outside the fuel tank via the second opening 423.

In contrast to the fuel delivery module 200 shown and described above, the fuel delivery module 400 does not include a separate filter cover and pump cover, but rather includes a single cover 470 that is coupled to the second end portion 420 of the housing 402. In this manner, the cover 470 is disposed about both the opening 421 and the opening 423. Although shown as being coupled to the housing via a bolts or capscrews, the cover 470 can be coupled to the second end portion 420 of the housing 402 in any suitable manner, such as, for example, by clips, snap rings, a threaded flange or the like. In some embodiments, the cover 470 can be coupled to the second end portion 420 of the housing 402 such that a fluid-tight seal is formed between the a surface of the cover 470 and a surface of the second end portion 420 of the housing 402. In other embodiments, the cover 470 can include one or more seals (e.g., o-rings) to form a fluid-tight seal between the a surface of the cover 470 and a surface of the second end portion 420 of the housing 402. In some embodiments, the cover 470 can be fixedly coupled to the second end portion 420 of the housing 402. In other embodiments, the cover 470 can be removably coupled to the second end portion 420 of the housing 402, as described above.

Figure 16:
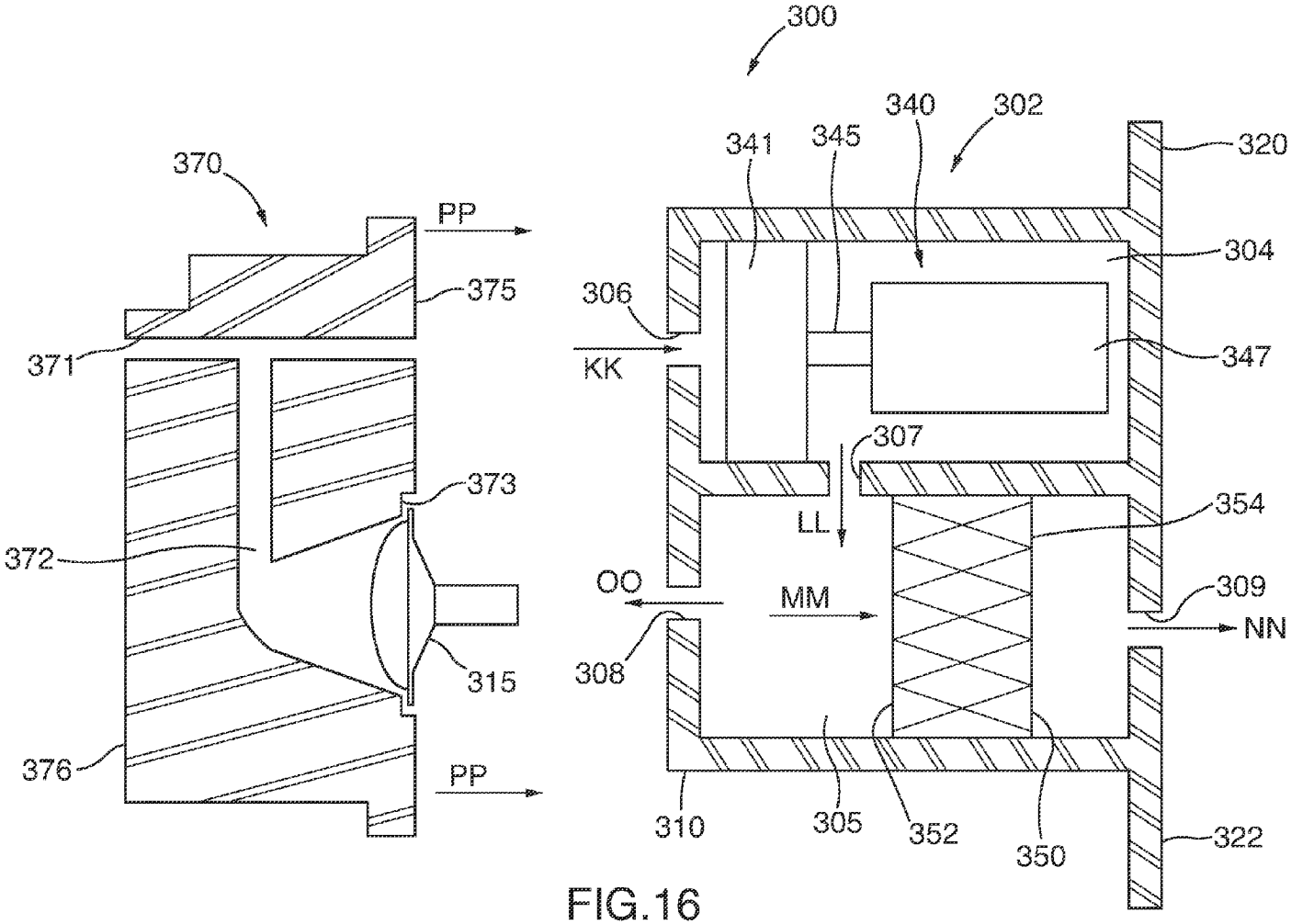
FIG. 16 is a schematic illustration of a fluid delivery module according to an embodiment.

In some embodiments, a fuel delivery module can be installed in an "in-line" configuration such that the fuel delivery module is disposed entirely outside of the fuel tank. For example, FIG. 16 is a schematic illustration of an in-line fluid delivery module 300 according to an embodiment. The fluid delivery module 300 is disposed outside of a fluid reservoir (not shown) configured to contain a fluid. The fluid delivery module 300 is configured to convey the fluid from the fluid reservoir to a location outside the fluid reservoir, while also being disposed outside of the fluid reservoir, as described herein. The fluid delivery module 300 includes a housing 302, a pump assembly 340, regulator 315, a filter media 350 and a cover 370. The housing 302 includes a first end portion 310 and a second end portion 320, and defines a first cavity 304 and a second cavity 305. The first cavity 304 is substantially separated from the second cavity 305 via a side wall of the housing 302. In some embodiments, however, the first cavity 304 and the second cavity 305 can be separated by any structure, such as, for example, a sealing ring, a sealing plate and/or the like. The first cavity 304 is in fluid communication with the second cavity 305 via an opening 307 defined by the side wall 303. In this manner, fluid from the first cavity 304 can flow through the opening 307 and into the second cavity 305, as shown by the arrow LL. Although the first cavity 304 and the second cavity 305 are illustrated as having substantially the same size and shape, in other embodiments, the first cavity 304 and/or the second cavity 305 can have any suitable size and/or shape. Additionally, although the first cavity 304 is illustrated as being proximal to the second cavity 305, in other embodiments, the first cavity 304 can be located in any position and/or orientation relative to the second cavity 305.

The first cavity 304 is configured to contain the pump assembly 340. More specifically, the first cavity 304 is configured to substantially enclose the pump assembly 340 within the housing 302. The pump assembly 340 includes a pump mechanism 341, a shaft 345 and a pump motor 347. The pump mechanism 341 can be any suitable mechanism for producing a pressure and/or fluid flow within the fluid delivery module 300, as described herein. In some embodiments, the pump mechanism 341 can be a positive displacement pump such as a gear pump, a vane pump, a piston pump or the like. In other embodiments, the pump mechanism can be a non-positive displacement mechanism (e.g., a turbine pump). The pump motor 347 can be any suitable motor, such as, for example, a commercially-available DC motor.

The second cavity 305 is configured to contain the filter media 350 having a first end 352 and a second end 354. As described herein, a fluid within the second cavity 305 can flow into the first end 352 of the filter media 350, as shown by the arrow MM, and out of the second end 354 of the filter media 350. The filter media 350 can be any suitable filter media, such as, for example, paper, fiberglass or the like. In some embodiments, the filter media 350 and a portion of a surface (not identified) of the second cavity 305 can form a substantially fluid-tight seal such that fluid cannot flow between the surface and the filter media 350, as described herein.

The first end portion 330 of the housing 302 includes an inlet opening 306 and an outlet opening 308. The inlet opening 306 is configured to fluidically couple the first cavity 304 to a portion of the cover 370, as described herein. In this manner, fluid from the fluid reservoir can flow into the first cavity 304 and to the pump assembly 340, as shown by the arrow KK. Similarly, the outlet 308 is configured to fluidically couple the second cavity 305 to a regulator cavity 373 of the cover 370, as described herein.

The second end portion 320 of the housing 302 includes a flange 322 and defines an outlet 309. The outlet 309 is configured to fluidically couple the second cavity 305 to a region outside of an/or downstream from the fluid delivery module 300. In this manner, fluid from the second cavity 305 can flow through the outlet 309 to a region beyond the fluid delivery module 300 (e.g., to an engine), as shown by the arrow NN. In some embodiments, the outlet 309 can be connected to a fluid line (not shown) configured to convey fluid from the second cavity 305 to, for example, an engine (not shown). In some embodiments, the outlet 309 can include a check valve to prevent flow in a direction opposite the direction shown by the arrow NN.

The flange 322 can be coupled to any suitable structure to maintain the location and/or position of the fluid delivery module 300 within the fuel system. In some embodiments, the flange 322 can include mounting hardware (e.g., clips) to facilitate mounting the fluid delivery module 300 to a portion of a vehicle (not shown).

The cover 370 has a first end portion 375 and a second end portion 375, and defines a first lumen 371, a second lumen 372, a regulator cavity 373. In some embodiments, the first portion 375 of the cover 370 is configured to be removably coupled to the first end portion 310 of the housing 302 by moving the cover 370 in direction PP, as shown in FIG. 16. Similarly stated, the first portion 375 of the cover 370 is configured to be coupled to the first end portion 310 of the housing 302 in a manner configured to allow the cover 370 to be repeatedly removed and recoupled to the first end portion 310 of the housing 302. In this manner, the cover 370 can be removed from the first end portion 310 of the housing 302 to allow the filter media 350 and/or the pump assembly 350 to be serviced and/or replaced. The first portion 375 of the cover 370 can be coupled to the first end portion 310 of the housing 302 in any suitable manner, such as for example, by a bolted joint connection, by a snap ring, by a threaded coupling, by an interference fit and/or the like.

The first lumen 371 defined by the cover 370 is substantially aligned with the inlet opening 306 of the first end portion 310 of the housing 302 when the cover 370 is coupled to the first end portion 310 of the housing 302. In this manner, the first lumen 371, which extends through the cover 370, can convey a fluid from the fluid reservoir (not shown) to the inlet 306. In some embodiments, the first lumen 371 can be coupled to a fluid line disposed, at least in part, within a fluid reservoir. In this manner, the first lumen 371 can fluidically couple the first cavity 304 to the fluid reservoir.

The second lumen 372 defined by the cover 370 is in fluid communication with the regulator cavity 373 and the first lumen 371. In this manner, the second lumen 372 is configured to fluidically couple the regulator cavity 373 to the first lumen 371. The regulator cavity 373 is configured to be substantially aligned with the outlet opening 308 of the first end portion 310 of the housing 302 when the cover 370 is coupled to the first end portion 310 of the housing 302. The regulator cavity 373 includes the regulator 315 disposed therein such that a portion of the regulator 315 is substantially aligned with the outlet opening 308 of the first end portion 310 of the housing 302 when the cover 370 is coupled to the first end portion 310 of the housing 302. In this manner, when the pressure of the fuel within the unfiltered portion of the second cavity 305 exceeds a predetermined threshold, the regulator 315 can open, thereby allowing a portion of the fluid within the second cavity 305 to flow from the second cavity 305 in direction OO via the outlet opening 308, as described in more detail below.

In use, a fluid from, for example, a fluid reservoir, is conveyed through the first lumen 371 and into the inlet opening 306, and further into the first cavity 304, as shown by the arrow KK. More specifically, the pump assembly 340 disposed within the first cavity 304 can produce a vacuum that draws the fluid from the fluid reservoir into the first cavity 304 in the manner previously described. The fluid in the first cavity 304 can be referred to as "unfiltered fluid." The unfiltered fluid is then conveyed through the opening 307 and into the second cavity 305, as shown by the arrow LL. The unfiltered fluid moves through the filter media 350 disposed within the second cavity 305, as shown by arrow MM. More specifically, the unfiltered fuel enters the filter media 350 via the first end 352, moves through the filter media 350, and exits the filter media 350 via the second end 354. In this manner, the fluid exiting the second end 354 of the filter media 350 is considered "filtered fluid." The filtered fluid within the second cavity 305 is conveyed through the outlet 309, as shown by arrow NN. In this manner, the fluid delivery module 300 provides filtered fluid to a region beyond the fluid delivery module 300.

In some instances, when the pressure of the fluid within the second cavity 305 exceeds a predetermined value, a portion of the fluid in the second cavity 305 is conveyed from the second cavity 305 and returned to the inlet opening 306. More specifically, the regulator 315 can open, thereby allowing a portion of the fluid (the bypass fluid) to flow via the outlet opening 308 into the cover 370, as shown by the arrow OO. The bypass fluid then flows within the second lumen 372 and into the first lumen 371. The bypass fluid then flows into the first lumen 371 and into the inlet opening 306, as described above.

The components included in the integrated fuel delivery module shown and described above can be manufactured by any suitable method. For example, in some embodiments, a fuel pump cover (e.g., fuel pump cover 280) and/or a filter cover (e.g., filter cover 260) can be cast and/or machined from a metallic material. In other embodiments, a fuel pump cover and/or a filter cover can be molded from a plastic material and/or a composite material. In some embodiments, a fuel pump cover and/or a filter cover can each be monolithically constructed. In other embodiments, a fuel pump cover and/or a filter cover can each be constructed by coupling multiple separate pieces together.

Figure 17:
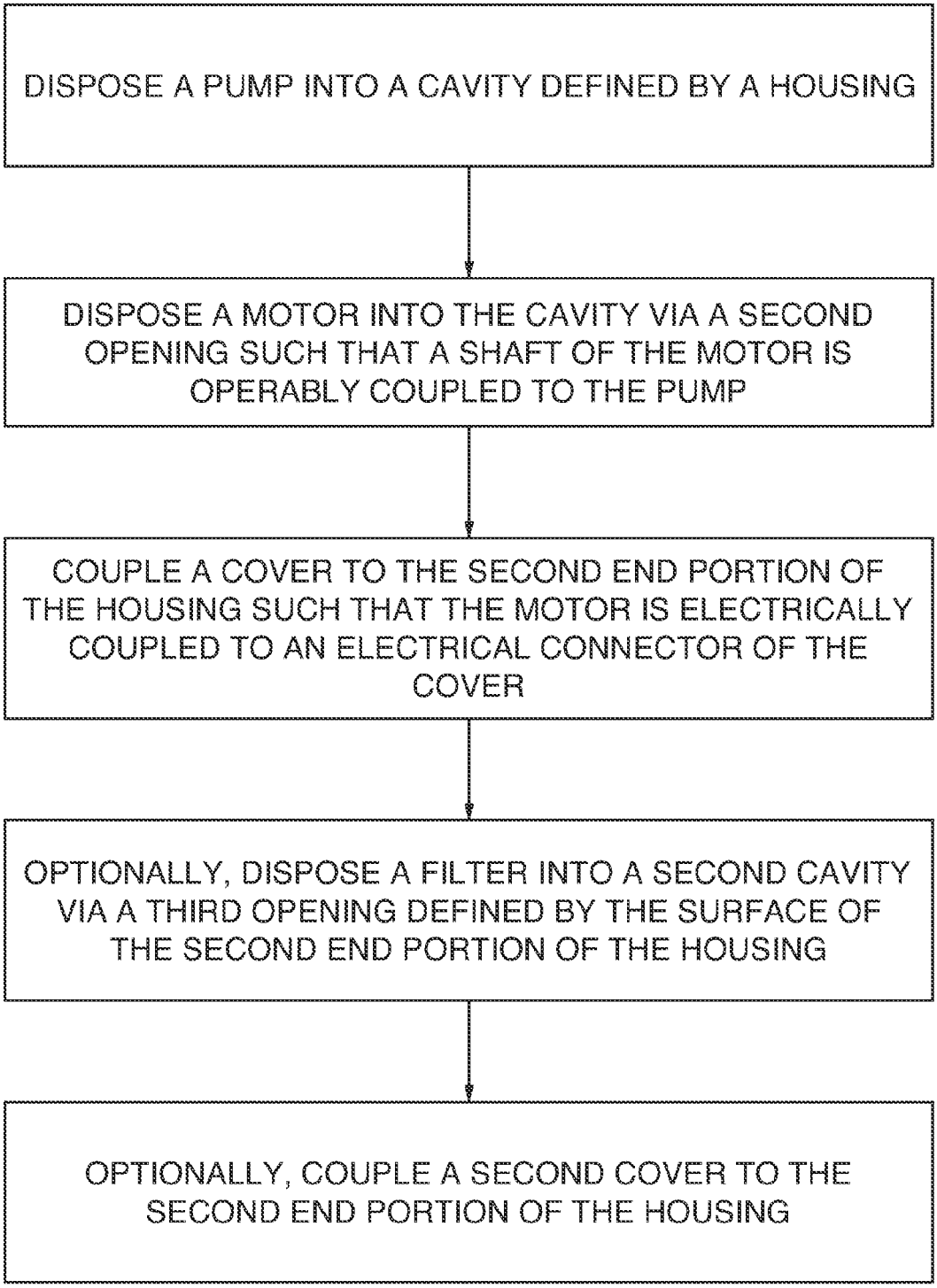
FIG. 17 is a flow chart of a method of assembly or servicing a fuel delivery module according to an embodiment.

Similarly, the integrated fuel delivery modules shown and described above can be assembled by any suitable method. For example, FIG. 17 is a flow chart of a method 590 of assembling and/or servicing an integrated fuel delivery module according to an embodiment. The illustrated method includes disposing a pump into a cavity defined by a housing, 591. The pump can be any of the pumping mechanisms shown and described herein (e.g., the gerotor pumping stage 295). The housing, which can be any of the housings shown and described herein (e.g., housing 202), has a first end portion and a second end portion. The first end portion of the housing is configured to be disposed within a fluid reservoir. The second end portion includes a flange configured to be disposed outside of and coupled to the fluid reservoir when the first end portion of the housing is disposed within the fluid reservoir. A surface of the first end portion of the housing defines a first opening in fluid communication with the cavity. Likewise, a surface of the second end portion of the housing defines a second opening in fluid communication with the cavity. The pump is disposed into the cavity via the second opening of the housing. In some embodiments the pump can be disposed within the cavity such that a protrusion of the pump housing is disposed within a recess defined by a side wall of the housing.

A motor is disposed into the cavity via the second opening such that a shaft of the motor is operatively coupled to the pump, 592. The motor can be any of the motors shown and described herein (e.g., pump motor 347). In some embodiments, the motor can be a commercially-available DC motor or the like.

A cover is coupled to the second end portion of the housing such that the motor is electrically coupled to an electrical connector of the cover, 593. The cover, which can be any of the covers shown and described herein (e.g., pump cover 280), can be coupled to the second end portion of the housing in any suitable manner. In some embodiments, for example, the cover can be coupled to the second portion of the housing via spin welding. In some such embodiments, the cover can be spin welded to the second end portion of the housing by rotating the cover and the motor relative to the housing.

In some embodiments the cavity is a first cavity and the housing defines second cavity. In some such embodiments, the method optionally includes disposing a filter into the second cavity via a third opening defined by the surface of the second end portion of the housing, 594. Moreover, the method optionally includes coupling a second cover to the second end portion of the housing, 595. The second cover can be coupled to the second end portion of the housing in any suitable manner.

Figure 18:
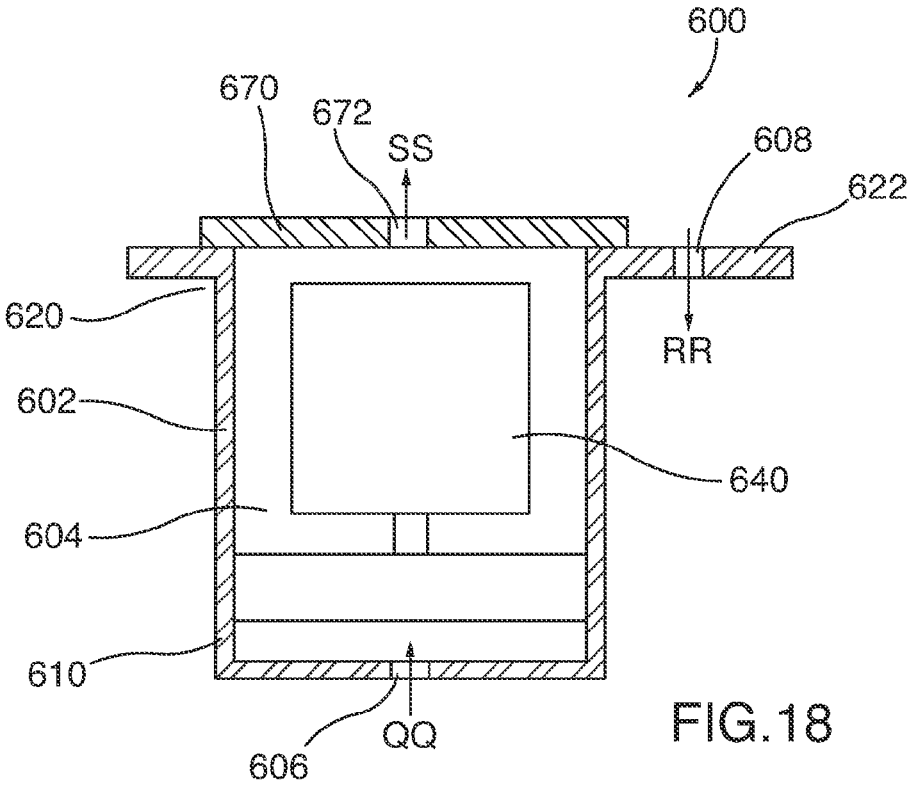
FIG. 18 is a schematic illustration of a fluid delivery module according to an embodiment.

Although the fluid delivery and/or fuel delivery modules shown and described above include a filter and a pump (see e.g., fluid delivery module 100) or a filter, a pump and a regulator (see e.g., fuel delivery module 200), in other embodiments, a fluid delivery module can include any suitable combination of a filter, a pump and/or a regulator. For example, FIG. 18 is a schematic illustration of a fluid delivery module 600 that includes a housing 602, a pump assembly 640 and a cover 670. The fluid delivery module 600 can be coupled to and/or at least partially within a fluid reservoir (not shown in FIG. 18), as described above.

The housing 602 includes a first end portion 610 and a second end portion 620, and defines a cavity 604. The pump assembly 640 is disposed within the cavity 604. More specifically, the cavity 604 substantially encloses the pump assembly 640 within the housing 602. The pump assembly 640 can include any suitable mechanism for producing a pressure and/or fluid flow within the fluid delivery module 600 as described herein. In some embodiments, the pump assembly 640 can include a positive displacement pump such as a gerotor pump as discussed above with reference to pump assembly 240. Moreover, the pump assembly 640 can be assembled within the cavity 604 according to the methods described above.

The first end portion 610 of the housing 602 defines an inlet opening 606 configured to fluidically couple the cavity 604 to the fluid reservoir. In this manner, fluid from the fluid reservoir can flow into the cavity 604, as shown by the arrow QQ in FIG. 18. In some embodiments, the inlet 606 can be connected to a fluid intake or suction line (not shown) configured to convey fluid from the fluid reservoir to the inlet opening 606. In some embodiments (e.g., those embodiments in which the pump assembly 640 includes a positive displacement pump), the housing 602 can be configured and/or sized such that the inlet opening 606 is at any location within the fluid reservoir. Similarly stated, in some embodiments, the housing 602 can be configured and/or sized without requiring that the inlet opening 606 be submerged in fluid within the fluid reservoir. This arrangement allows flexibility to use the fluid delivery module 600 in any number of different fluid tanks When the fluid delivery module 600 is coupled to the fluid reservoir, at least portion of the second end portion 620 of the housing 602 is disposed outside of the fluid reservoir. In this manner, the cavity 604 is accessible from outside of the fluid reservoir 601 via an opening 609 when the first end portion 610 of the housing 602 is disposed within the fluid reservoir. Thus, the pump assembly 640 disposed within the cavity 604 can be removed, replaced and/or repaired from outside of the fluid reservoir via the opening 609 when the first end portion 610 of the housing 602 is disposed within the fluid reservoir.

The second end portion 620 of the housing 602 includes a flange 622. The flange 622 is disposed outside of and coupled to the fluid reservoir. When the flange 622 is coupled to the fluid reservoir, the first end portion 610 of the housing 602 is disposed within the fluid reservoir. The flange 622 can be coupled to the fluid reservoir in any suitable manner, as described above. The flange 622 defines an opening 608 that places the region outside of the fluid reservoir in fluid communication with the fluid reservoir when the flange 622 is coupled to the fluid reservoir. In some embodiments, the flange 622 can include a fitting and/or connector (not shown in FIG. 18) to allow a fluid line to be fluidically coupled to the opening 608. This arrangement allows a fluid return line to be coupled to the opening 608. In this manner, return fluid from a regulator (e.g., a regulator disposed elsewhere in the fluid system, not shown in FIG. 18) can be returned to the fluid reservoir via the fluid delivery module 600, as shown by the arrow RR.

The cover 670 is removably coupled to the second end portion 620 of the housing 602. In this manner, the cover 670 can be removed from the second end portion 620 of the housing 602 when the housing 602 is coupled to the fluid reservoir to allow the cavity 604 to be accessed from a region outside of the fluid reservoir via the opening 609. The cover 670 can be coupled to the second end portion 620 of the housing 602 in any suitable manner, as described above.

The cover 670 defines an outlet opening 672 configured to fluidically couple the cavity 604 to a region outside of the fluid reservoir. In this manner, when the pump assembly 640 is actuated, pressurized fluid from the cavity 604 can flow through the outlet opening 672 to a region outside of the fluid reservoir, as shown by the arrow SS in FIG. 18. In some embodiments, the outlet opening 672 can be connected to a fluid line (not shown) configured to convey fluid from the cavity 604 to, for example, an engine (not shown).

Figure 19:
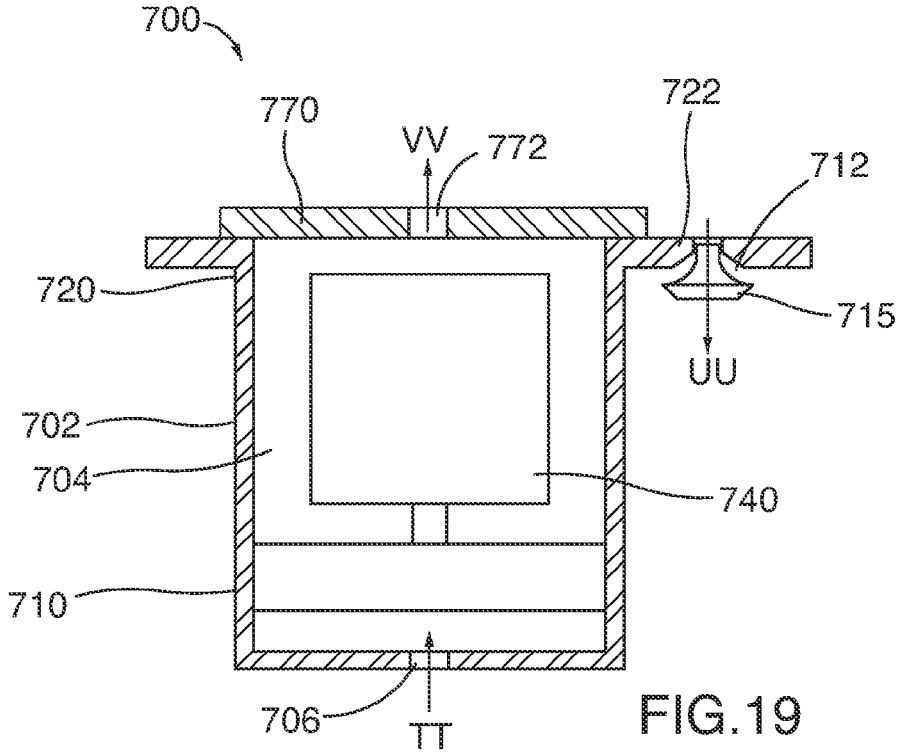
FIG. 19 is a schematic illustration of a fluid delivery module according to an embodiment.

FIG. 19 is a schematic illustration of a fluid delivery module 700 that includes a housing 702, a pump assembly 740, a regulator 715 and a cover 770. The fluid delivery module 700 can be coupled to and/or at least partially within a fluid reservoir (not shown in FIG. 19), as described above. The housing 702 includes a first end portion 710 and a second end portion 720, and defines a cavity 704. The pump assembly 740 is disposed within the cavity 704. More specifically, the cavity 704 substantially encloses the pump assembly 740 within the housing 702. The pump assembly 740 can include any suitable mechanism for producing a pressure and/or fluid flow within the fluid delivery module 700 as described herein. In some embodiments, the pump assembly 740 can include a positive displacement pump such as a gerotor pump as discussed above with reference to pump assembly 240. Moreover, the pump assembly 740 can be assembled within the cavity 704 according to the methods described above.

The first end portion 710 of the housing 702 defines an inlet opening 706 configured to fluidically couple the cavity 704 to the fluid reservoir. In this manner, fluid from the fluid reservoir can flow into the cavity 704, as shown by the arrow TT in FIG. 19. In some embodiments, the inlet 706 can be connected to a fluid intake or suction line (not shown) configured to convey fluid from the fluid reservoir to the inlet opening 706. In some embodiments (e.g., those embodiments in which the pump assembly 740 includes a positive displacement pump), the housing 702 can be configured and/or sized such that the inlet opening 706 is at any location within the fluid reservoir. Similarly stated, in some embodiments, the housing 702 can be configured and/or sized without requiring that the inlet opening 706 be submerged in fluid within the fluid reservoir. This arrangement allows flexibility to use the fluid delivery module 700 in any number of different fluid tanks When the fluid delivery module 700 is coupled to the fluid reservoir, at least portion of the second end portion 720 of the housing 702 is disposed outside of the fluid reservoir. In this manner, the cavity 704 is accessible from outside of the fluid reservoir 701 via an opening 709 when the first end portion 710 of the housing 702 is disposed within the fluid reservoir. Thus, the pump assembly 740 disposed within the cavity 704 can be removed, replaced and/or repaired from outside of the fluid reservoir via the opening 709 when the first end portion 710 of the housing 702 is disposed within the fluid reservoir.

The second end portion 720 of the housing 702 includes a flange 722. The flange 722 is disposed outside of and coupled to the fluid reservoir. When the flange 722 is coupled to the fluid reservoir, the first end portion 710 of the housing 702 is disposed within the fluid reservoir. The flange 722 can be coupled to the fluid reservoir in any suitable manner, as described above. The flange 722 defines a regulator pocket 712 that places the region outside of the fluid reservoir in fluid communication with the fluid reservoir when the flange 722 is coupled to the fluid reservoir. In some embodiments, the flange 722 can include a fitting and/or connector (not shown in FIG. 19) to allow a fluid line (e.g., a return line) to be fluidically coupled to the regulator pocket 712.

The regulator 715 can be any suitable regulator for regulating a fluid pressure and/or a fluid flow within the fluid system, including, but not limited to, pressure and or flow within the cavity 704. The regulator 715 is coupled to the flange 722 of the housing 702 by any suitable mechanism, such as a regulator clip (not shown in FIG. 19) of the type shown and described above. When the regulator 715 is coupled to the flange 722 of the housing 702, a portion of the regulator 715 is disposed within and in fluid communication with the regulator cavity 712. In this manner, the regulator 715 is fluidically coupled to the return line via the regulator cavity 712. In this manner, a flow and/or pressure within the fluid system can be returned to the fluid reservoir via the fluid delivery module 700, as shown by the arrow UU.

The cover 770 is removably coupled to the second end portion 720 of the housing 702. In this manner, the cover 770 can be removed from the second end portion 720 of the housing 702 when the housing 702 is coupled to the fluid reservoir to allow the cavity 704 to be accessed from a region outside of the fluid reservoir via the opening 709. The cover 770 can be coupled to the second end portion 720 of the housing 702 in any suitable manner, as described above.

The cover 770 defines an outlet opening 772 configured to fluidically couple the cavity 704 to a region outside of the fluid reservoir. In this manner, when the pump assembly 740 is actuated, pressurized fluid from the cavity 704 can flow through the outlet opening 772 to a region outside of the fluid reservoir, as shown by the arrow VV in FIG. 19. In some embodiments, the outlet opening 772 can be connected to a fluid line (not shown) configured to convey fluid from the cavity 704 to, for example, an engine (not shown).

Figure 20:
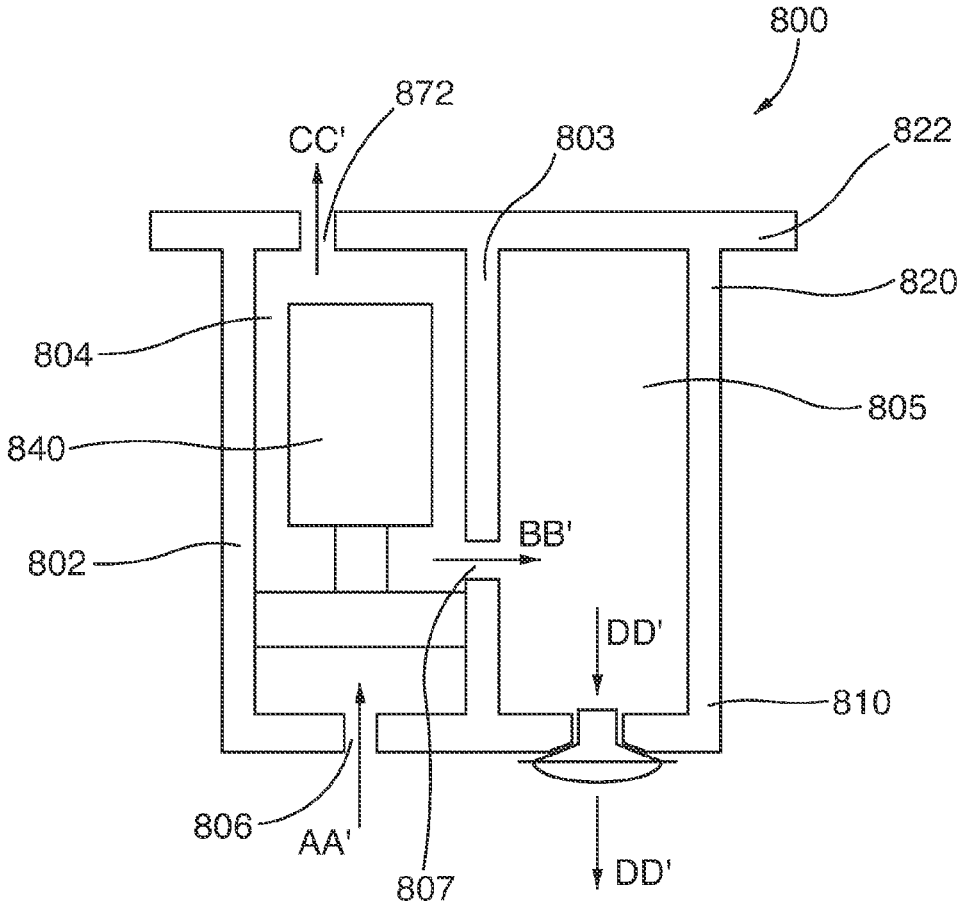
FIG. 20 is a schematic illustration of a fluid delivery module according to an embodiment.

Although the fuel delivery module 200 has been shown and described above as including a regulator (e.g., regulator 215) configured to receive and/or regulate filtered fuel, in other embodiments, a fuel delivery module can include a regulator configured to receive and/or regulate unfiltered fuel. For example, FIG. 20 is a schematic illustration of a fluid delivery module 800 that includes a housing 802, a pump assembly 840, a regulator 815 and a cover 870. The fluid delivery module 800 can be coupled to and/or at least partially within a fluid reservoir (not shown in FIG. 19), as described above.

The housing 802 includes a first end portion 810 and a second end portion 820, and defines a first cavity 804 (i.e., a pump cavity) and a second cavity 805 (i.e., a regulator cavity). The first cavity 804 is substantially separated from the second cavity 805 via a side wall (e.g., side wall 803) of the housing 802. The first cavity 804 is in fluid communication with the second cavity 805 via an opening 807 defined by the side wall 803. In this manner, fluid from the first cavity 804 can flow through the opening 807 and into the second cavity 805, as shown by the arrow BB' in FIG. 20.

As shown in FIG. 20, the pump assembly 840 is disposed within the first cavity 804. More specifically, the first cavity 804 substantially encloses the pump assembly 840 within the housing 802. The pump assembly 840 can include any suitable mechanism for producing a pressure and/or fluid flow within the fluid delivery module 800 as described herein. In some embodiments, the pump assembly 840 can include a positive displacement pump such as a gerotor pump as discussed above with reference to pump assembly 240. Moreover, the pump assembly 840 can be assembled within the first cavity 804 according to the methods described above.

The first end portion 810 of the housing 802 defines an inlet opening 806 configured to fluidically couple the first cavity 804 to the fluid reservoir. In this manner, fluid from the fluid reservoir can flow into the first cavity 804, as shown by the arrow AA' in FIG. 20. In some embodiments, the inlet 806 can be connected to a fluid intake or suction line (not shown) configured to convey fluid from the fluid reservoir to the inlet opening 806. In some embodiments (e.g., those embodiments in which the pump assembly 840 includes a positive displacement pump), the housing 802 can be configured and/or sized such that the inlet opening 806 is at any location within the fluid reservoir. Similarly stated, in some embodiments, the housing 802 can be configured and/or sized without requiring that the inlet opening 806 be submerged in fluid within the fluid reservoir. This arrangement allows flexibility to use the fluid delivery module 800 in any number of different fluid tanks.

When the fluid delivery module 800 is coupled to the fluid reservoir, at least portion of the second end portion 820 of the housing 802 is disposed outside of the fluid reservoir. In this manner, the first cavity 804 can be accessed from outside of the fluid reservoir 801 via an opening 809 when the first end portion 810 of the housing 802 is disposed within the fluid reservoir. Thus, the pump assembly 840 disposed within the cavity 804 can be removed, replaced and/or repaired from outside of the fluid reservoir via the opening 809 when the first end portion 810 of the housing 802 is disposed within the fluid reservoir.

As shown in FIG. 20, the regulator 815 is at least partially disposed within and/or in fluid communication with the second cavity 805. The regulator 815 can be any suitable regulator for regulating a fluid pressure and/or a fluid flow within the fluid system, including, but not limited to, pressure and or flow within the second cavity 805. Because the second cavity 805 is in fluid communication with the first cavity 804, this arrangement allows for the regulator 815 to regulate the pressure and/or flow within the first cavity. The regulator 815 is coupled to the flange 822 of the housing 802 by any suitable mechanism, such as a regulator clip (not shown in FIG. 20) of the type shown and described above.

The second end portion 820 of the housing 802 includes a flange 822. The flange 822 is disposed outside of and coupled to the fluid reservoir. When the flange 822 is coupled to the fluid reservoir, the first end portion 810 of the housing 802 is disposed within the fluid reservoir. The flange 822 can be coupled to the fluid reservoir in any suitable manner, as described above.

The flange 822 defines an outlet opening 872 configured to fluidically couple the first cavity 804 to a region outside of the fluid reservoir. In this manner, when the pump assembly 840 is actuated, pressurized fluid from the cavity 804 can flow through the outlet opening 872 to a region outside of the fluid reservoir, as shown by the arrow CC' in FIG. 20. In some embodiments, the outlet opening 872 can be connected to a fluid line (not shown) configured to convey fluid from the cavity 804 to, for example, an engine (not shown). When the pressure within the first cavity 804 (i.e., from the pump assembly 840 output) exceeds a threshold, the regulator 815 provides a flow path for a portion (the "return" portion) of the unfiltered fluid to return to the fluid reservoir, as shown by the arrows DD' in FIG. 20. More particularly, the "return" portion of the unfiltered fluid can flow from the first cavity 804 to the second cavity 805 via the opening 807, and the return to the fluid reservoir via the regulator 815.

While various embodiments have been described above, it should be understood that they have been presented by way of example only, and not limitation. Where methods and/or schematics described above indicate certain events and/or flow patterns occurring in certain order, the ordering of certain events and/or flow patterns may be modified. Additionally certain events may be performed concurrently in parallel processes when possible, as well as performed sequentially. While the embodiments have been particularly shown and described, it will be understood that various changes in form and details may be made.

Although the fuel delivery module 200 is shown and described above as including a positive displacement pumping assembly 240, in other embodiments, any of the delivery modules can include a non-positive displacement pump assembly (e.g., a turbine pump). In such embodiments, the housing can be configured to contact a bottom surface of the reservoir within which the delivery module is disposed. In some such embodiments, for example, the housing can include an inlet filter assembly coupled to the inlet opening (e.g., inlet opening 211) in place of the inlet fitting (e.g., inlet fitting 214).

Although the regulator 215 is shown as being a "contained" regulator having the regulating components (e.g., valve body, springs, valve seats, etc.) packaged within a regulator housing, in other embodiments, a fuel delivery module can include a regulator that is assembled within the housing 202. For example, in such embodiments, for example, the housing 202 can include a valve seat (not shown in FIGS. 2-12) disposed within the regulator cavity 212. The valve seat can be, for example, press fit and/or molded into the regulator cavity 212, and can provide a seat surface against which a valve element (e.g., a ball, not shown in FIGS. 2-12) can be disposed to fluidically isolate the regulator cavity 212 from the region outside of the housing 202 (i.e., when the ball is in the "closed" position). Moreover, in such embodiments, the clip 216 can include a spring retainer portion that is configured to retain a spring or other biasing member in contact with the valve element such that when the pressure within the cavity exceeds a predetermined threshold, the valve element be displaced from the valve seat, thereby allowing a portion of the fluid to flow from the second cavity 205 back to the fuel tank via the regulator cavity 212.

Although the fuel delivery module 200 has been shown and described above as including a regulator (e.g., regulator 215) configured to receive and/or regulate filtered fuel, in other embodiments, a fuel delivery module can include a regulator configured to receive and/or regulate unfiltered fuel. Similarly stated, although the fuel delivery modules have been shown and described above as including a regulator disposed downstream of the filter, in other embodiments, a fuel delivery modules can include a regulator disposed upstream of the filter.

Although the filter cover 260 is shown and described above as being coupled to the housing 202 by screws (i.e., coupling member 263), in other embodiments, the filter cover 260 can be removably coupled to the housing by any suitable mechanism. For example, in some embodiments, a cover can be can be removably coupled to the housing by a snap ring configured to be disposed within a groove defined by the housing (not shown in the figures above) and engage a portion of the cover. In this manner, the cover can be coupled to the housing in any desired orientation. Said another way, in this manner, the cover can be coupled to the housing in any rotational position, thereby allowing the angular position of the fuel outlet fitting to be easily changed for different applications.

Although the first end portion 210 and second end portion 220 are monolithically constructed in other embodiments, the first end portion and the second end portion can be constructed separately and coupled together via any suitable coupling means, such as, for example, welding.

Although various embodiments have been described as having particular features and/or combinations of components, other embodiments are possible having a combination of any features and/or components from any of embodiments as discussed above. For example, although the fuel delivery modules have been shown and described above as being used with a fuel tank, in other embodiments, a fluid delivery module of the types shown and described herein can be disposed within any suitable tank. For example, in some embodiments, a fluid delivery module can be configured to convey a hydraulic fluid, a saline solution, water or any other suitable fluid as part of a fluidic process. In such embodiments, the fluid delivery module can be used with any suitable container (e.g., a reservoir, a barrel, a tank, a flow conduit or the like).

What is claimed is:

1. An apparatus, comprising:

a housing defining a first cavity, a second cavity and a lumen configured to provide fluid communication between the first cavity and the second cavity, the housing having a first end portion configured to be disposed within a fluid reservoir and a second end portion including a flange configured to be disposed outside of and coupled to the fluid reservoir, a surface of the first end portion of the housing defining a first opening in fluid communication with the first cavity, a surface of the second end portion of the housing defining a second opening in fluid communication with the second cavity, the housing defining a third opening at the first end portion of the housing and a fourth opening at the second end portion of the housing, the third opening and the fourth opening each in fluid communication with the lumen;

a pump disposed within the first cavity;

a filter disposed within the second cavity; and a cover configured to be removably coupled to the second end portion of the housing about the second opening such that the filter can be removed from the second cavity when the flange is coupled to the fluid reservoir.

2. The apparatus of claim 1, wherein the housing is monolithically constructed.

3. The apparatus of claim 1, wherein the pump is configured to remain at a fixed distance from the flange when the flange is coupled to the fluid reservoir.

4. The apparatus of claim 1, wherein a length of the lumen is at least half a length of the second cavity.

5. The apparatus of claim 1, wherein:

the surface of the first end portion of the housing is opposite the surface of the second end portion of the housing; and the surface of the second end portion of the housing defines a fifth opening in fluid communication with the first cavity.

6. The apparatus of claim 1, wherein the pump is a positive displacement pump.

7. The apparatus of claim 1, wherein:

the surface of the first end portion of the housing is a bottom surface; and the pump is a gerotor pump including a gerotor housing and at least one gerotor element movably disposed within the gerotor housing, the gerotor housing fixedly coupled within the first cavity of the housing such that an inlet opening defined by the gerotor housing is at least partially aligned with the first opening.

8. The apparatus of claim 1, wherein the surface of the first end portion of the housing defines a fifth opening in fluid communication with the second cavity, the apparatus further comprising:

at least one of a valve seat, a valve element or a spring disposed within the fifth opening.

9. A method, comprising:

disposing a gerotor pump into a cavity defined by a housing, the housing having a first end portion configured to be disposed within a fluid reservoir and a second end portion including a flange configured to be disposed outside of and coupled to the fluid reservoir when the first end portion of the housing is disposed within the fluid reservoir, a surface of the first end portion of the housing defining a first opening in fluid communication with the cavity, a surface of the second end portion of the housing defining a second opening in fluid communication with the cavity, the disposing performed via the second opening, the disposing including disposing a gerotor housing within the cavity such that a protrusion of the gerotor housing is disposed within a recess defined by a side wall of the housing;

disposing a motor into the cavity via the second opening such that a shaft of the motor is operably coupled to the pump; and coupling a cover to the second end portion of the housing such that the motor is electrically coupled to an electrical connector of the cover.

10. The method of claim 9, wherein:

the disposing the gerotor pump includes disposing a the gerotor housing within the cavity such that an inlet opening defined by the gerotor housing is at least partially aligned with the first opening.

11. The method of claim 9, wherein coupling the cover includes spin welding the cover to the second end portion of the housing.

12. The method of claim 9, wherein coupling the cover includes spin welding the cover to the second end portion of the housing by rotating the cover and the motor relative to the housing.

13. The method of claim 9, wherein the cover is a first cover and the cavity is a first cavity, the method further comprising:

disposing a filter into a second cavity via a third opening defined by the surface of the second end portion of the housing; and coupling a second cover to the second end portion of the housing.

14. The method of claim 9, wherein the cavity is a first cavity, the method further comprising:

disposing a valve seat into a second cavity via a third opening defined by the surface of the first end portion of the housing; and disposing a valve element into the second cavity separately from the disposing the valve seat.

15. An apparatus, comprising:

a housing defining a first cavity, a second cavity and a lumen configured to provide fluid communication between the first cavity and the second cavity, the housing having a first end portion configured to be disposed within a fluid reservoir and a second end portion including a flange configured to be disposed outside of and coupled to the fluid reservoir, a surface of the first end portion of the housing defining a first opening in fluid communication with the first cavity, a surface of the second end portion of the housing defining a second opening in fluid communication with the second cavity and a third opening in fluid communication with the first cavity, the surface of the first end portion of the housing being opposite the surface of the second end portion of the housing;

a pump disposed within the first cavity;

a filter disposed within the second cavity; and a cover configured to be removably coupled to the second end portion of the housing about the second opening such that the filter can be removed from the second cavity when the flange is coupled to the fluid reservoir.

16. The apparatus of claim 15, wherein the housing defines a fourth opening at the first end portion of the housing and a fifth opening at the second end portion of the housing, the fourth opening and the fifth opening each in fluid communication with the lumen.

17. The apparatus of claim 15, wherein the pump is configured to remain at a fixed distance from the flange when the flange is coupled to the fluid reservoir.

18. The apparatus of claim 1, wherein the surface of the first end portion of the housing defines a fourth opening in fluid communication with the second cavity, the apparatus further comprising:

at least one of a valve seat, a valve element or a spring disposed within the fourth opening.

19. A method, comprising:

disposing a pump into a cavity defined by a housing, the housing having a first end portion configured to be disposed within a fluid reservoir and a second end portion including a flange configured to be disposed outside of and coupled to the fluid reservoir when the first end portion of the housing is disposed within the fluid reservoir, a surface of the first end portion of the housing defining a first opening in fluid communication with the cavity, a surface of the second end portion of the housing defining a second opening in fluid communication with the cavity, the disposing performed via the second opening;

disposing a motor into the cavity via the second opening such that a shaft of the motor is operably coupled to the pump; and spin welding a cover to the second end portion of the housing such that the motor is electrically coupled to an electrical connector of the cover.

20. The method of claim 19, wherein the housing defines a lumen configured to provide fluid communication between the first cavity and the second cavity.

* * * * *